US011427441B2

(12) United States Patent
Fauconnet et al.

(10) Patent No.: US 11,427,441 B2
(45) Date of Patent: Aug. 30, 2022

(54) ELEVATOR CAR WITH FOLDABLE WORKING PLATFORM

(71) Applicant: Otis Elevator Company, Farmington, CT (US)

(72) Inventors: Aurelien Fauconnet, Isdes (FR); Frederic Beauchaud, Coullons (FR); Romain Marechal, Gien (FR); Guillaume Montigny, Gien (FR); Arnaud Caze, Chailly en Gatinais (FR); Emmanuel Convard, La Bussiere (FR); Michael Rigot, Gien (FR); Joachim Angoulevant, Gien (FR); Agustin Jimenez-Gonzalez, Alcorcon (ES); Juan Quiles Manzanas, Rivasvaciamadrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 88 days.

(21) Appl. No.: 16/937,112

(22) Filed: Jul. 23, 2020

(65) Prior Publication Data

US 2022/0024724 A1 Jan. 27, 2022

(51) Int. Cl.

| | |
|---|---|
| ***B66B 11/02*** | (2006.01) |
| ***B66B 9/00*** | (2006.01) |
| ***B66B 5/00*** | (2006.01) |

(52) U.S. Cl.

CPC ..... *B66B 11/0246* (2013.01); *B66B 5/0087* (2013.01); *B66B 9/00* (2013.01)

(58) Field of Classification Search

CPC . B66B 11/0246; B66B 5/0087; B66B 5/0043; B66B 5/005; B66F 3/22

See application file for complete search history.

(56) References Cited

U.S. PATENT DOCUMENTS 5,139,110 A 8/1992 Kishi
5,927,745 A 7/1999 Cunningham
(Continued)

FOREIGN PATENT DOCUMENTS

CN 103043572 A * 4/2013
CN 103043572 A 4/2013
(Continued)

OTHER PUBLICATIONS

Machine translation of CN 103043572.*
(Continued)

*Primary Examiner* — Diem M Tran
(74) *Attorney, Agent, or Firm* — Cantor Colburn LLP

(57) ABSTRACT

An elevator car defining an interior space for accommodating passengers and/or cargo, comprising a support frame positioned above the interior space, a working platform moveable between a stowed position, above the interior space, and an operational position, within the interior space and at least one extendable suspension arrangement arranged to suspend the working platform from the support frame. The extendable suspension arrangement includes a connection plate, a first arm member connected at a first end to the support frame and slidably connected to a first connection point of the connection plate and a second arm member connected at another first end to the working platform and slidably connected to a second connection point of the connection plate.

15 Claims, 23 Drawing Sheets

(56) References Cited

U.S. PATENT DOCUMENTS

| | | | | |
|---|---|---|---|---|
| 6,202,801 | B1 * | 3/2001 | Muller | B66B 11/0246 187/269 |
| 6,419,052 | B1 | 7/2002 | Muller et al. | |
| 6,691,833 | B1 | 2/2004 | Elsener et al. | |
| 6,880,678 | B1 | 4/2005 | Schneider | |
| 7,337,880 | B2 | 3/2008 | Sittler | |
| 9,193,566 | B1 | 11/2015 | Nieves et al. | |
| 9,540,220 | B2 | 1/2017 | Stewart et al. | |
| 9,546,078 | B2 | 1/2017 | Paasisalo | |
| 2006/0289244 | A1 | 12/2006 | Sittler | |
| 2007/0056809 | A1 * | 3/2007 | Fernandes | B66B 11/0246 187/401 |
| 2007/0056810 | A1 | 3/2007 | Fernandes et al. | |
| 2008/0105497 | A1 | 5/2008 | Ashley et al. | |
| 2012/0085032 | A1 | 4/2012 | Heikintupa et al. | |
| 2017/0297870 | A1 | 10/2017 | Fauconnet et al. | |
| 2017/0340104 | A1 | 11/2017 | Chuang | |
| 2018/0086604 | A1 | 3/2018 | Fonteneau et al. | |
| 2018/0105395 | A1 | 4/2018 | Cortes | |
| 2018/0339879 | A1 | 11/2018 | Quaretti et al. | |
| 2019/0031472 | A1 | 1/2019 | Salin | |
| 2019/0263629 | A1 | 8/2019 | Fernandez et al. | |
| 2019/0330023 | A1 | 10/2019 | Fauconnet et al. | |
| 2019/0389698 | A1 * | 12/2019 | Jimenez-Gonzalez | B66B 11/0246 |
| 2020/0277163 | A1 | 9/2020 | Fauconnet et al. | |
| 2021/0002104 | A1 | 1/2021 | Fauconnet et al. | |
| 2021/0155458 | A1 * | 5/2021 | Montigny | B66B 11/0246 |

FOREIGN PATENT DOCUMENTS

| | | | | |
|---|---|---|---|---|
| CN | 102515000 | B | 10/2013 | |
| CN | 204474273 | U | 7/2015 | |
| CN | 104828737 | A | 8/2015 | |
| CN | 104944318 | A | 9/2015 | |
| CN | 105178578 | A | 12/2015 | |
| CN | 207087802 | U | 3/2018 | |
| CN | 208150909 | U | 11/2018 | |
| CN | 209194955 | U | 8/2019 | |
| CN | 110203798 | A | 9/2019 | |
| DE | 10104351 | A1 | 8/2002 | |
| DE | 10104351 | A1 * | 8/2002 | |
| DE | 102006023920 | A1 | 11/2007 | |
| EP | 0280828 | A2 | 9/1988 | |
| EP | 1533265 | A1 | 5/2005 | |
| EP | 1760026 | A1 | 3/2007 | |
| EP | 1760029 | A1 | 3/2007 | |
| EP | 1760029 | A1 * | 3/2007 | B66B 11/0246 |
| EP | 2243742 | A1 | 10/2010 | |
| EP | 2277819 | A1 | 1/2011 | |
| EP | 2456704 | B1 | 4/2016 | |
| EP | 3530603 | A1 | 8/2019 | |
| EP | 3587333 | A1 | 1/2020 | |
| ES | 2460290 | A1 | 11/2014 | |
| JP | H0640700 | A | 2/1994 | |
| JP | H0749359 | B2 | 5/1995 | |
| JP | H0825718 | B2 | 3/1996 | |
| JP | H0825719 | B2 | 3/1996 | |
| JP | H09263372 | A | 10/1997 | |
| JP | 6431381 | B2 | 11/2018 | |
| WO | 2016098089 | A1 | 6/2016 | |
| WO | 2018208926 | A1 | 11/2018 | |

OTHER PUBLICATIONS

European Search Report for Application No. 18179543.6; dated Dec. 7, 2018; 7 pages.

European Search Report for Application No. 20305845.8; dated Jan. 28, 2021; 6 Pages.

* cited by examiner

ELEVATOR CAR WITH FOLDABLE WORKING PLATFORM

TECHNICAL FIELD

This disclosure relates to an elevator car with a foldable working platform used to carry out maintenance from inside an elevator car. The foldable nature of the working platform is assisted by one or more extendable suspension arrangements.

BACKGROUND

It is known to provide working platforms located in or above the ceiling of elevator cars, which are moveable between a stowed position and a deployed position. In the deployed position, the working platform is located within the elevator car, at such a height that a maintenance person is able to stand on the working platform and access elevator components through an opening in the elevator car ceiling. Typically such a working platform is suspended from at least one pair of suspension arms. EP-3587333-A1 discloses a working platform that is moveably mounted to a support frame by at least one scissor mechanism.

The range of movement of a scissor mechanism is limited by the dimensions of the working platform to which the mechanism is attached. Even employing telescopic arms in the scissor mechanism, the dimensions of the working platform can place constraints on its range of movement. This can be an issue for smaller elevator cars where the footprint of the working platform is reduced. However, the height of the working platform when it is deployed is important for ensuring that a maintenance person can access components above the ceiling of the car and also take refuge in the elevator car in an emergency.

SUMMARY

According to a first aspect of this disclosure there is provided an elevator car defining an interior space for accommodating passengers and/or cargo, the elevator car comprising: a support frame positioned above the interior space; a working platform moveable between a stowed position, above the interior space, and an operational position, within the interior space; and at least one extendable extendable suspension arrangement arranged to suspend the working platform from the support frame, the extendable suspension arrangement comprising a connection plate; a first arm member connected at a first end to the support frame and slidably connected to a first connection point of the connection plate; a second arm member connected at a first end to the working platform and slidably connected to a second connection point of the connection plate; wherein the first arm member and the second arm member are configured to slide parallel to each other, along a sliding direction, in order to extend the extendable suspension arrangement when the working platform moves between the stowed position and the operational position, and wherein the first connection point and the second connection point have an offset from one another at least in a direction perpendicular to the sliding direction.

By connecting the first and second arm members slidably to the connection plate at offset first and second connection points, an extendable suspension arrangement is provided which has both a long extension height and a compact footprint (i.e. in the plane of the working platform). When the working platform is in the operational position, a second end of the first arm member is adjacent to a second end of the second arm member, providing a long extension height of the suspension arrangement, thereby allowing the working platform to be lowered to the desired height. As the working platform is moved from the operational position to the stowed position, the first arm member and the second arm member slide parallel to each other relative to the connection plate. In the stowed position, the first end of the first arm member is adjacent the second end of the second arm member, and the first end of the second arm member is adjacent the second end of the second arm member. Due to the offset perpendicular to the sliding direction, the first arm member and the second arm member are able to slide into this "stacked" configuration, thereby providing a compact arrangement.

In some examples, the first connection point and the second connection point additionally have another offset from one another along the sliding direction. This helps to further increase the length of the extendable suspension arrangement when in the "extended" position, the position of the extendable suspension arrangement when the working platform is in the operational position.

As the first and second arm members slide relative to the connection plate, the extendable suspension arrangement will expand or collapse. Depending on various factors, such as the size and/or shape of the connection plate, and the way in which the arm members are connected to the connection points on the connection plate, the extendable suspension arrangement may be able to collapse down into a relatively compact configuration. For example, the first arm member may be pivotably connected to the first connection point of the connection plate and/or the second arm member may be pivotably connected to the second connection point of the connection plate. This means that the first and second arm members may slide parallel to one another and pivot so as to bring the sliding direction into alignment with the working platform, the extendable suspension arrangement collapsing down to lie close to the working platform in the stowed position. In other words, the sliding direction may move relative to the connection plate.

The inventors have realised that collapsing the extendable suspension arrangement can be made easier by arranging for the connection plate to pivot. In some examples, in addition or alternatively, the connection plate comprises a pivot point, arranged such that the connection plate rotates about the pivot point when the working platform moves between the stowed position and the operational position. This means that the first and second arm members can slide parallel to one another at the same time as the connection plate is rotating so as to bring the sliding direction into alignment with the working platform. The extendable suspension arrangement may collapse down to lie close to the working platform in the stowed position. In at least some examples, the connection plate rotates about the pivot point to bring the first arm member and the second arm member into alignment with the working platform and/or the support frame when the working platform moves to the stowed position.

In at least some examples, the pivot point is located centrally between the first connection point and the second connection point. Thus, as the working platform is moved, and the first and second arm members slide parallel to each other, the connection plate rotates around this central pivot point. The extendable suspension arrangement may therefore extend and collapse in a symmetrical way.

In at least some examples, the sliding direction is constant with respect to the connection plate. The first connection point and the second connection point are part of the connection plate i.e. they are fixed relative to the connection plate. In some examples, the first connection point and the second connection point are arranged to define the sliding direction, thus giving a sliding direction which is constant with respect to the connection plate. Thus, in those examples in which the connection plate rotates around a pivot point, the sliding direction will also rotate with the connection plate. This arrangement helps the "stacked" first and second arm members to rotate to a substantially horizontal position, thereby providing an extendable suspension arrangement with a particularly small vertical extension, when the working platform is in the stowed position.

In at least some examples, the working platform in the stowed position and the support frame are both located above the interior space. In some examples, the working platform in the stowed positon is at least partially overlapping with the support frame. In the stowed position the working platform may sit within the support frame.

In some examples, in addition or alternatively, the first connection point comprises a first projection and the first arm member comprises a slot, and the first projection is configured to slide in the slot. This provides a simple mechanism, which requires few additional parts and few moving parts, and gives a sliding connection. In some examples, the slot extends along substantially the entire length of the first arm member. This helps to maximise the height of the extendable suspension arrangement in the fully extended position. In some examples, the connection plate further comprises a second projection, also configured to slide in the slot of the first arm member. This helps to improve the stability of the suspension arrangement, and to keep the first and second arm members sliding parallel to each other. This arrangement of two projections also defines the sliding direction for each respective arm.

Similarly, the second connection point may comprise a first projection and the second arm member may comprise a slot, and the first projection is configured to slide in the slot. In some examples, the slot extends along substantially the entire length of the second arm member. In some examples, the connection plate further comprises a second projection, also configured to slide in the slot of the second arm member.

The first arm member is connected at a first end to the support frame and the second arm member is connected at a first end to the working platform. Optionally the first end of the first arm member is connected to the support frame at a corner of the support frame. Optionally the first end of the second arm member is connected to a corner of the working platform. In some examples, the corner of the support frame is an opposite corner to the corner of the working platform. For example, if the extendable suspension arrangement is connected on one side of an elevator car (where a "side" is defined relative to the elevator doors being on a "front" side of the elevator car), then the first arm member may be connected to the front corner of the support frame e.g. adjacent to the doors, whilst the second arm member is connected to the back corner of the working platform e.g. adjacent to the back wall of the elevator car.

In some examples, in addition or alternatively, the elevator car comprises a first extendable suspension arrangement and a second extendable suspension arrangement, wherein the first extendable suspension arrangement suspends the working platform from a first side of the support frame, and wherein the second extendable suspension arrangement suspends the working platform from a second, opposing side of the support frame. In such examples the working platform is stably suspended by a pair of extendable suspension arrangements extending from opposite sides of the support frame.

In some examples, in addition or alternatively, the first extendable suspension arrangement further comprises: a secondary connection plate; a secondary first arm member connected at a first end to the support frame and slidably connected to a first connection point of the secondary connection plate; a secondary second arm member connected at a first end to the working platform and slidably connected to a second connection point of the secondary connection plate; wherein the first arm member and the second arm member are configured to slide parallel to each other, along a sliding direction, and wherein the first connection point and the second connection point are offset perpendicular to the sliding direction.

The statements made herein above in reference to the first and second arm members and the connection plate may apply likewise to the secondary connection plate and the secondary first and second arm members. In some examples the first connection plate and the secondary connection plate are attached together at their respective pivot points, so as to be movable relative to each other. This provides additional stability to the extendable suspension arrangement and allows each connection plate to rotate in opposite directions, so that each set of arm members may lay substantially horizontally and stacked respectively one on top of the other when the working platform is in the stowed position.

In at least some examples, in addition or alternatively, the elevator car further comprises a cover panel, which is configured to cover the working platform when the working platform is in the stowed position. This advantageously allows the working platform, when in the stowed position, to be covered neatly and therefore hidden from the view of any passengers who might use the elevator car, improving the experience of the passengers. The cover panel may, for example, comprise a decorative ceiling cover panel. In one or more examples, the cover panel may be pivotably attached to the support frame. In such examples, the cover panel may pivot relative to the support frame to cover the working platform when the working platform is in the stowed position.

In some examples, in addition or alternatively, the elevator car further comprises a counterforce generator configured to provide a counterforce, and a tension member, connected to the working platform and to the counterforce generator, so as to transmit the counterforce and thereby hoist the working platform from the operational position to the stowed position. Such arrangements can provide a user with mechanical assistance when moving the working platform between its operational and stowed positions.

This is considered to be both novel and inventive in its own right, and therefore, according to a second aspect of this disclosure, there is provided an elevator car defining an interior space for accommodating passengers and/or cargo, the elevator car comprising: a support frame positioned above the interior space; a working platform suspendably connected to the support frame and moveable between a stowed position, above the interior space, and an operational position, suspended within the interior space; a counterforce generator configured to provide a counterforce in an upwards vertical direction; and a tension member connected to the working platform and to the counterforce generator so as to transmit the counterforce and thereby hoist the working platform in the upwards vertical direction.

It will be appreciated that according to this second aspect of the present disclosure, and corresponding examples according to the first aspect, a counterforce generator and a tension member act together to assist in moving the working platform from the operational position to the stowed position, thereby providing improved handling of the working platform. This means that a maintenance person does not need to push against the full weight of the working platform when returning the working platform to the stowed position i.e. the maintenance person does not need to apply a sufficiently large upwards force to overcome the whole weight of the working platform. For example, if the working platform weighs 30 kg but the counterforce generator provides a counterforce equivalent to 25 kg, then a maintenance person only needs to lift the equivalent of 5 kg to move the working platform from the operational position to the stowed position.

Furthermore, the counterforce generator combined with the tension member provides an advantage not only in assisting the upwards movement of the working platform from the operational position to the stowed position, but also in improved handling when moving the working platform from the stowed position to the operational position. The counterforce in the upwards vertical direction acts against the weight of the working platform and any force applied by a maintenance person, so that it damps the motion of the working platform as it moves downwards from the stowed position to the operational position, preventing the working platform from suddenly dropping down from the stowed positon. This is advantageous since a sudden drop of the working platform could cause damage to a mechanism suspending the working platform and could cause harm to a maintenance person operating the working platform.

The following description applies equally to examples according to the first and second aspects of the present disclosure.

In at least some examples, the counterforce is slightly larger than the weight of the working platform. This means that the counterforce generator and tension member can act to automatically hoist the working platform to its stowed position in the absence of any weight being applied by a maintenance person.

In at least some examples, the counterforce is approximately equal to the weight of the working platform. This means that the weight of the working platform is approximately balanced by the counterforce such that the maintenance person need only apply a small force to move the working platform from the stowed position to the operational position, or from the operational position to the stowed position.

In some examples, in addition or alternatively, the counterforce generator is a hoisting device and the tension member is arranged such that a suspending portion of the tension member suspends the working platform, wherein the hoisting device is configured, when actuated, to alter the length of the suspending portion, so as to hoist the working platform between the stowed position and the operational position. This means that a maintenance person does not need to push the working platform up to the stowed position unassisted i.e. the maintenance person does not need to apply a large upwards force to overcome the whole weight of the working platform. Rather, the maintenance person can adjust the length of the suspending portion of the tension member and thereby move the working platform from the operational position to the stowed position without actually having to lift the working platform, allowing controlled adjustment of the working platform.

In various examples of the present disclosure, the tension member is a flexible member, for example a flexible rope, cable or belt.

In some examples, in addition or alternatively, the counterforce generator is positioned at the working platform. The location of the hoisting device at the working platform is advantageous since a maintenance person is able to easily access the hoisting device from inside the elevator car, even when the working platform is in the stowed position, and thus deployment of the working platform is both easy and convenient for the maintenance person. In some examples the hoisting device is attached to the working platform. Preferably the hoisting device is attached to an underside of the working platform. This allows the hoisting device to be stored discreetly and prevents the hoisting device from taking up useful space on the working platform or within the elevator car, whilst also being very easily accessible to a maintenance person from within the elevator car. Optionally, the tension member may be arranged to pass through or round the working platform to connect to the counterforce generator.

It will be understood by the skilled person that the statement that the tension member is "connected" to the working platform describes not only the case in which one or both ends of the tension member are fixed e.g. hitched to the working platform, but also any other suitable arrangement in which the tension member passes through, under, or around the working platform, in a manner which allows the suspending portion of the tension member to suspend the working platform. For example, the tension member could undersling the working platform. In examples in which the hoisting device is attached to the working platform, the tension member may be indirectly connected to the working platform by virtue of being connected to the hoisting device which is itself attached to the working platform.

In some examples, in addition or alternatively, the tension member connects the counterforce generator to a connection point which moves relative to the working platform as the working platform is moved between the stowed position and the operational position.

The connection point may be a fixed point in the elevator car, for example a connection point on the support frame, or a connection point on a wall or ceiling of the elevator car. In other examples, the tension member is connected to a connection point which moves relative to the working platform as the working platform is moved between the stowed position and the operational position. For example, the tension member may be connected to the extendable suspension arrangement e.g. to the connection plate of the suspension arrangement. In this case, for each unit of movement of the counterforce generator, the length of the suspending portion will be reduced by twice as much, compared to the case in which the tension member is connected to the support frame, because of the action of the suspension arrangement, and this therefore provides an improved roping arrangement. This arrangement is particularly well suited for small elevator cars and furthermore the cost of the spring element required for this arrangement is reduced, since a reduced stroke is required.

In some examples, in addition or alternatively, the counterforce generator maintains the suspending portion of the tension member at a given length, unless actuated by the application of a force i.e. the hoisting device is self-locking. This helps to improve the safety of the working platform, since this means that whenever a maintenance person has been moving the working platform using the hoisting device, and then ceases to actuate the hoisting device, the working platform will remain stationary at the height to which it had been moved, and will not begin to rise up, or fall down independently i.e. of its own accord. If the maintenance person stops the actuation then the hoisting device will lock in its current position, so that the risk of the working platform freefalling is significantly reduced. This helps the working platform to be both moved to the operational position and stowed smoothly and with minimal risk to a maintenance person, since this self-locking helps to prevent a possible safety hazard caused by this unexpected movement. Moreover, this helps to reduce the need to provide locking devices in order to fix the working platform in certain positions e.g. no locking mechanism may be required to fix the working platform in the stowed position or operational position, or any position in between, since it will be maintained in a given position by the hoisting device, unless the hoisting device is actuated. However, in one or more examples it may still be desirable for the elevator car to include a locking means for the working platform at least in the stowed position, e.g. for increased peace of mind and a safety back-up.

In some examples in addition or alternatively, the counterforce generator comprises at least one deflector such as a deflection sheave, and the tension member is arranged to pass over the at least one deflector. In some examples, the tension member could be arranged in a 1:1 roping ratio with the counterforce generator, such that the length of rope which is hoisted e.g. wound or gathered, by the counterforce generator is equal to the change in length of the suspending portion of the tension member. However, preferably the tension member is arranged in a higher roping ratio with the counterforce generator, for example a 2:1 roping arrangement, a 3:1 roping arrangement, or a 4:1 roping arrangement. In at least some examples, counterforce generator comprises at least one deflector, and the tension member is arranged to pass over the at least one deflector in a 3:1 roping arrangement. For explanation, in a 3:1 roping arrangement the deflector(s) are arranged such that for one unit of movement of the counterforce generator, the suspending portion of the tension member is altered in length three times as far.

In some examples, in addition or alternatively, the length of the tension member provides sufficient excess such that the suspending portion of the tension member can be lengthened to greater than the length required to reach the operational position i.e. allowing the tension member to go slack when the working platform is in the operational position. This helps to provide an arrangement in which the tension member is not required to bear the full weight of the working platform and any additional load e.g. of a maintenance person, when the working platform is in use in the operational position. This means that a smaller, lower load bearing tension member could potentially be used, and also helps to reduce wear and strain on the tension member.

In some examples, in addition or alternatively, the elevator car comprises a first tension member and a second tension member, each of the first and second tension members connected independently to the counterforce generator and to the working platform. This provides for redundancy in case of failure of one of the tension members. In at least some examples, in addition or alternatively, the elevator car comprises a first tension member arranged at a first side of the working platform and a second tension member arranged at a second side of the working platform, wherein the second side is an opposing side of the working platform to the first side. This provides a more balanced suspending force acting on the opposing sides of the working platform, such that each of the opposing sides is lifted by the counterforce generator approximately equally, allowing the working platform to remain approximately level as it is moved between the operational position and the stowed position and thereby providing smooth movement of the working platform.

In a first set of examples, the counterforce generator comprises at least one counterweight and the tension member is fixed at one end to the at least one counterweight and connected to the working platform such that, as the at least one counterweight moves downwards vertically relative to the elevator car, the working platform is hoisted from the operational position to the stowed position i.e. in the upwards vertical direction. This therefore provides an assistive upwards force as a maintenance person lifts the working platform to the stowed position, due to the lowering of the counterweights. In the reverse direction, as a maintenance person applies a downwards force moving the working platform from the stowed position to the operational position, the upwards movement of the at least one counterweight requires an additional force to be applied, which acts against the weight of the working platform and therefore damps and smooths the downward movement of the working platform towards the operational position.

There are many different arrangements of the at least one counterweight and the working platform which allow the working platform to be hoisted upwards as the counterweight moves downwards. For example, the tension member may be fixed at one end to a counterweight and arranged to pass under the working platform i.e. to undersling the working platform, with its other end fixed to a suitable connection point in the car, such that as the counterweights travel vertically downwards the working platform is hoisted vertically upwards. In some examples, the tension member is fixed at one end to the at least one counterweight and fixed at another end to the working platform i.e. in a 1:1 roping arrangement. This advantageously provides a simple arrangement of the tension member capable of hoisting the working platform as the at least one counterweight moves downwards.

In some examples, in addition or alternatively, the elevator car comprises one or more deflection sheaves and the tension member is arranged to pass over the one or more deflection sheaves between the at least one counterweight and the working platform. This advantageously reduces the risk of the tension member coming into contact with, or interfering with, any of the other components present within the elevator car. This also helps with designing a suitable layout for the counterforce generator in the elevator car, for example with the counterweight(s) positioned at a periphery of the interior space.

In some examples, in addition or alternatively, the at least one counterweight is configured to move within a surrounding structure. This advantageously provides a separation between the at least one counterweight and any other components present in the elevator car, and thereby reduces the risk of the counterweights contacting, or interfering with, any of the other components. The surrounding structure may be arranged within the interior space or outside the interior space, for example in or behind any walls of the elevator car.

In some examples, in addition or alternatively, the elevator car comprises a first counterweight arranged on a first side of the working platform, and connected to the working platform by a first tension member, and a second counterweight arranged on a second side of the working platform, wherein the second side is an opposing side of the working platform to the first side, and connected to the working platform by a second tension member. This advantageously provides a more balanced force acting on the opposing sides of the working platform, such that each of the opposing sides is lifted by the counterweight approximately equally, allowing the working platform to remain approximately level as it is moved between the operational position and the stowed position and thereby providing smooth movement of the working platform.

In a second set of examples, the counterforce generator comprises at least one spring element and the spring element is arranged to be compressed as the working platform is moved from the stowed position to the operational position, and thereby provide the counterforce acting to move the working platform from the operational position to the stowed position i.e. in the upwards vertical direction. In these examples, it is expansion of the spring element that provides the counterforce, transmitted by the tension member, hoisting the working platform from the operational position to the stowed position, thereby assisting a maintenance person in moving the working platform to the stowed position. Furthermore, as the working platform is moved from the stowed position to the operational position, the spring element is compressed, and this therefore requires a maintenance person operating the working platform to apply an additional force, sufficient to compress the spring element. This upwards force, transmitted by the tension member as the spring element is compressed, acts against the weight of the working platform and therefore damps the downwards motion of the working platform. This is advantageous since a sudden drop of the working platform could cause damage to the mechanism suspending the working platform and could cause harm to a maintenance person operating the working platform.

In the examples in which the counterforce generator is a hoisting device, it will be understood by the skilled person that the hoisting device may be any suitable device which is able to alter the length of the suspending portion as described, i.e. the hoisting device is a device which is configured to gather in (or out) or wind in (or out) the length of the tension member, so as to alter the length of the suspending portion.

The hoisting device may, for example, comprise an electrical motor arranged to wind the tension member around a collector (such as a drum). In some examples, the hoisting device may comprise a gas spring arranged to alter the length of the suspending portion. In some examples, the hoisting device may comprise a reduction gear assembly, or any other suitable mechanical device operable to alter the length of the suspending portion. In any of these examples, the hoisting device may be operated automatically or manually.

In some examples, in addition or alternatively, the hoisting device is rotationally driven to alter the length of the suspending portion e.g. thereby acting to hoist the working platform between the stowed position and the operational position. This allows rotational motion (applied automatically or by a maintenance person) to be converted into a relative shortening (or lengthening) of the suspending portion of the tension member, which thereby results in the working platform being lifted towards the stowed position, or lowered towards the operational position.

In some examples, in addition or alternatively, the hoisting device comprises a worm screw and a sliding member configured to slide along the worm screw when the worm screw is rotationally driven. The tension member is connected to the sliding member, such that when the sliding member moves the length of the suspending portion is altered. For example, as the worm screw is rotated, the sliding member moves the tension member and alters the length of the suspending portion. In at least some examples, the tension member is connected to the sliding member via one or more deflectors. Optionally, the deflectors may be deflection sheaves, for ease of running of the tension member. In at least some examples, the one or more deflectors are arranged to at least partially wind up the tension member as the sliding member moves in a first direction, thereby shortening the length of the suspending portion. The sliding member may be a worm gear in at least some examples. An end of the tension member may terminate at the sliding member.

The sliding member may comprise a hole, sized to receive the worm screw. The hole may comprise a plastic ring. The plastic ring may be self-lubricating. The hoisting device may further comprise an elongate rod, parallel to the worm screw and arranged to pass through the sliding member, wherein the sliding member is configured to slide along the elongate rod. This helps to provide stability to the hoisting device.

In some examples, in addition or alternatively, the pitch angle of the worm screw is 8 mm or less. This helps to make the worm screw self-locking at small increments of movement, such that the worm screw (hence the sliding member and therefore the working platform) will not move unless further force is applied to the worm screw to alter the length of the suspending portion again.

In one or more examples wherein the hoisting device is rotationally driven, the hoisting device may be driven directly, e.g. using a motor as a rotational drive. The motor may be operated automatically or manually. For example, the motor may be provided by a drill that is manually operated to drive the hoisting device (e.g. using a drill to turn the worm screw in some examples). The use of a drill reduces the exertion required by the maintenance person.

In one or more other examples, the hoisting device may be driven indirectly, e.g. using a crank connected to a rotating drive shaft. In at least some examples where the hoisting device comprises a worm screw, as discussed above, the hoisting device may further comprise a crank arranged to drive rotation of the worm screw. The crank may not be a permanent part of the hoisting device, but rather may be a separate tool stored at a location within the elevator system, for example under the working platform or in a cabinet on a landing floor of the elevator system. A crank provides a simple mechanism by which a maintenance person is able to actuate the hoisting device, in particular when standing in the elevator car below the working platform. Furthermore, the use of a crank is advantageous since cranks are often provided as a standard elevator maintenance tool and are often stored within the elevator car and hence are likely to be easily accessible to a maintenance person.

Normally a crank is connected to a rotating drive shaft at 90°. However, it has been recognised than when a person is standing below the working platform to operate the crank, it may be desirable for the crank to extend at an angle of more than 90°. This means that the crank does not hang down and potentially hit a user, as well as making it easier to operate. In at least some examples, the crank is arranged to extend at an angle of between 120° and 150° from the axis defined by the worm screw, and optionally at an angle of around 135°. This helps to protect the technician from harm and provides a good angle of approach for operating the crank. In order to prevent the crank from hanging down at an angle of 90° from the axis of the worm screw, the hoisting device may comprise a bracket arranged to limit the angle at which the crank extends.

More generally, manual actuation is desirable when a maintenance person is working in the car and thus in various examples the hoisting device may be manually actuatable. This means that a maintenance person can autonomously control the raising and/or lowering of the working platform.

According to a third aspect of the present disclosure there is provided an elevator system comprising an elevator car according to any of the examples disclosed herein, further comprising a main counterweight and one or more ropes or belts connected between the elevator car and the main counterweight.

DRAWING DESCRIPTION

Certain preferred examples of this disclosure will now be described, by way of example only, with reference to the accompanying drawings, in which.

Figure 5:
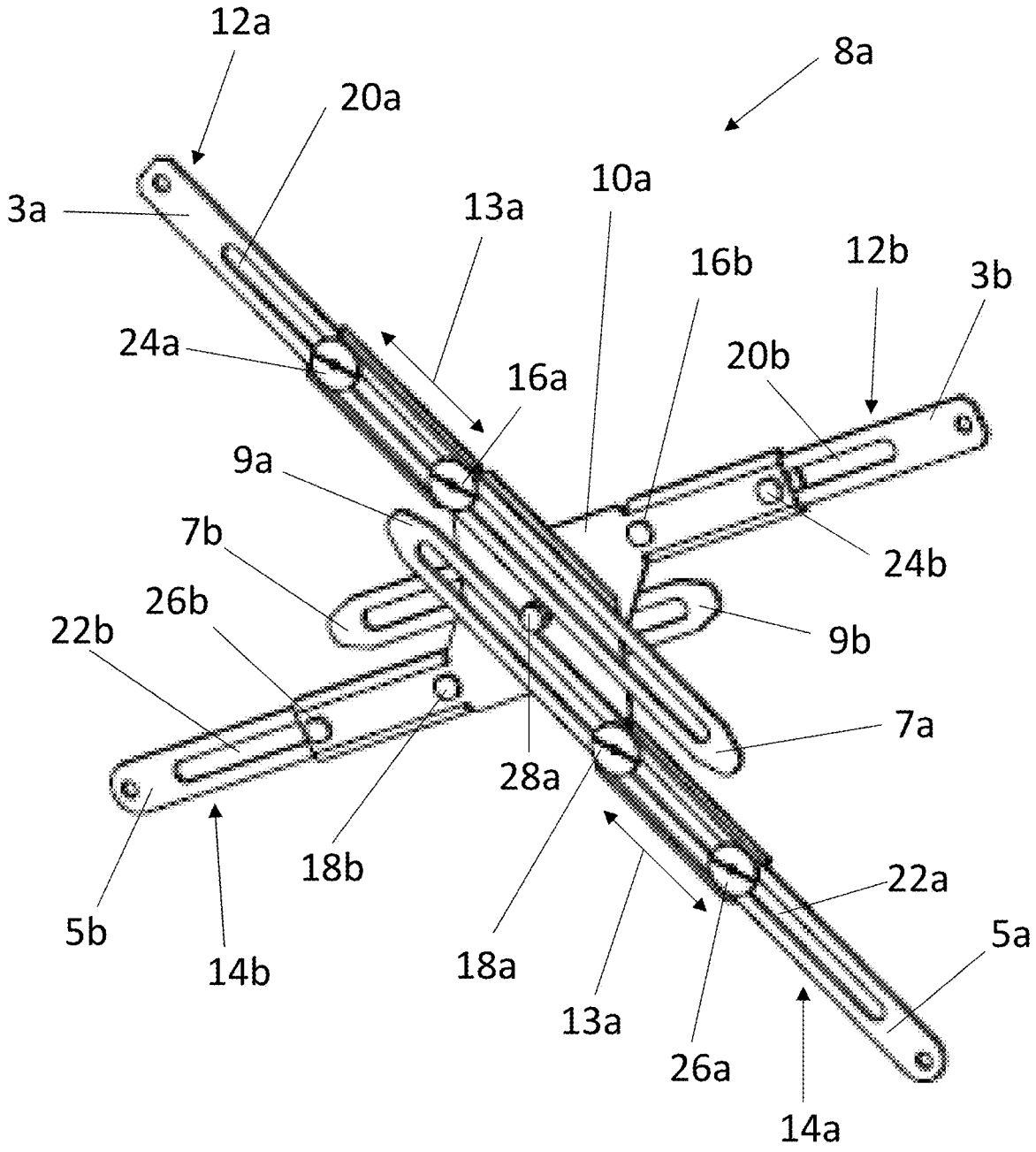
FIG. 5 shows a detailed side view of the extendable suspension arrangement, including a connection plate and first and second arm members, according to the first aspect of the present disclosure.
Figure 6A:
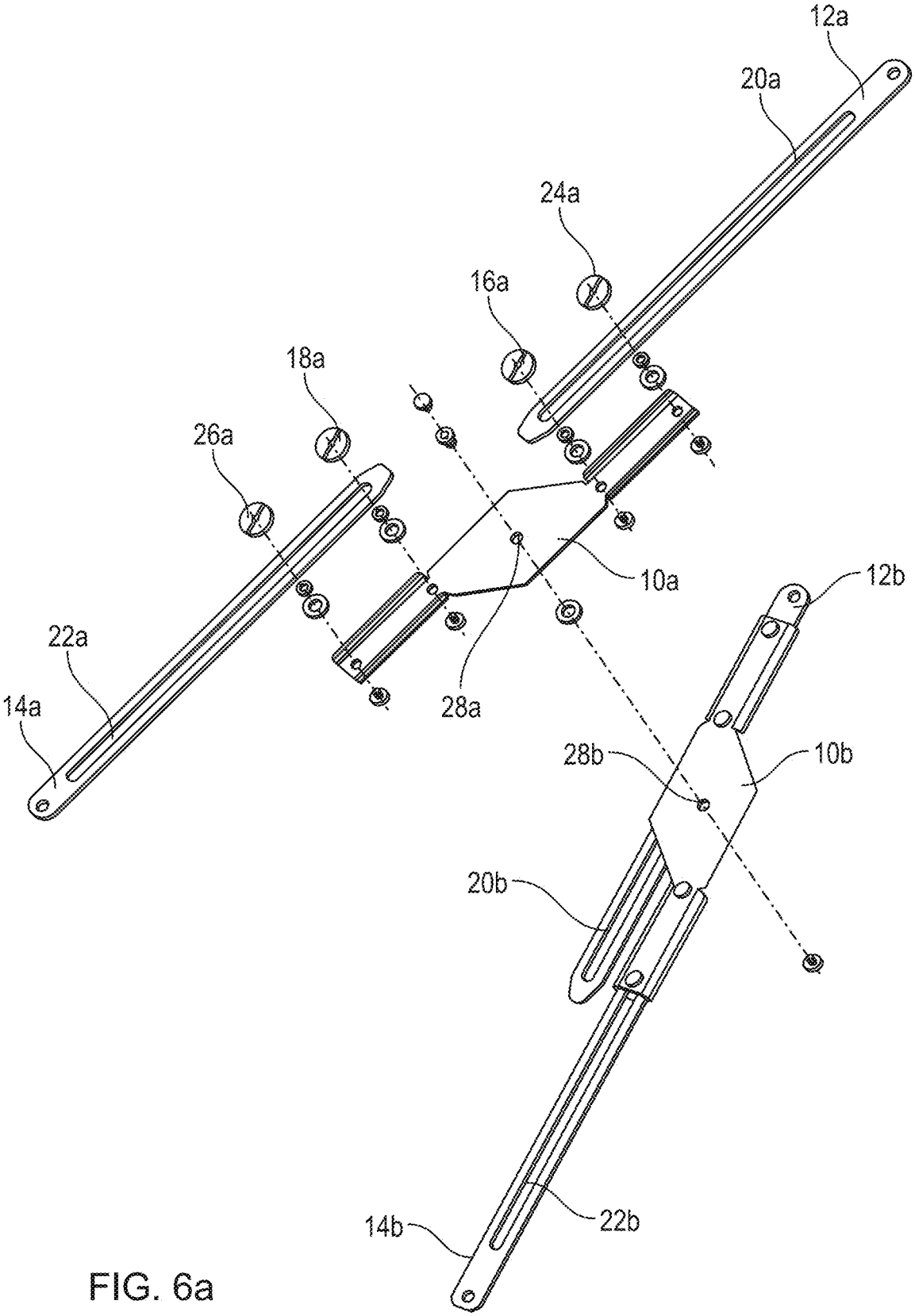
Figure 6B:
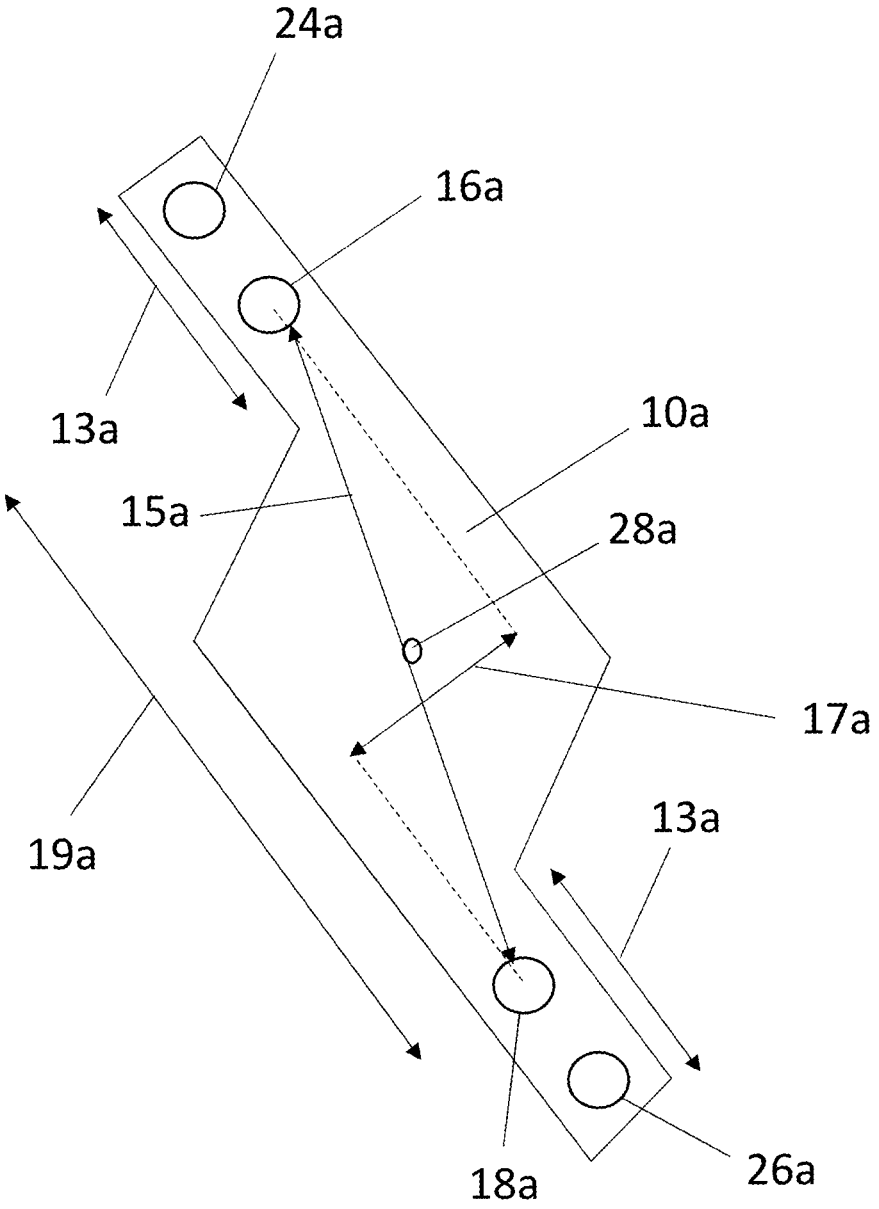

FIG. 6*a* shows a blown-apart view of the components shown in FIG. 5;

FIG. 6*b* shows a connection plate as seen in FIGS. 5 and 6*a;*

Figure 7:
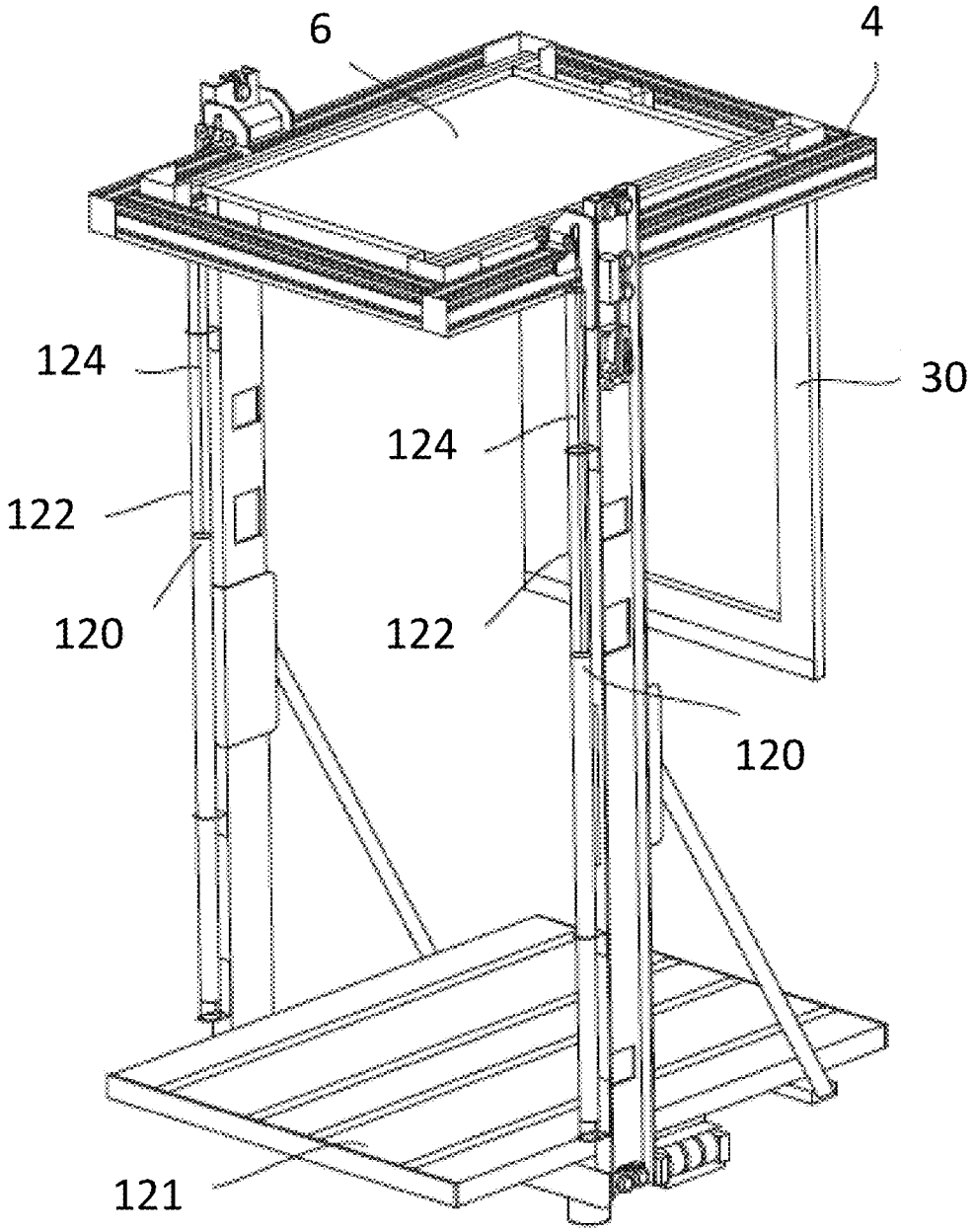
Figure 8:
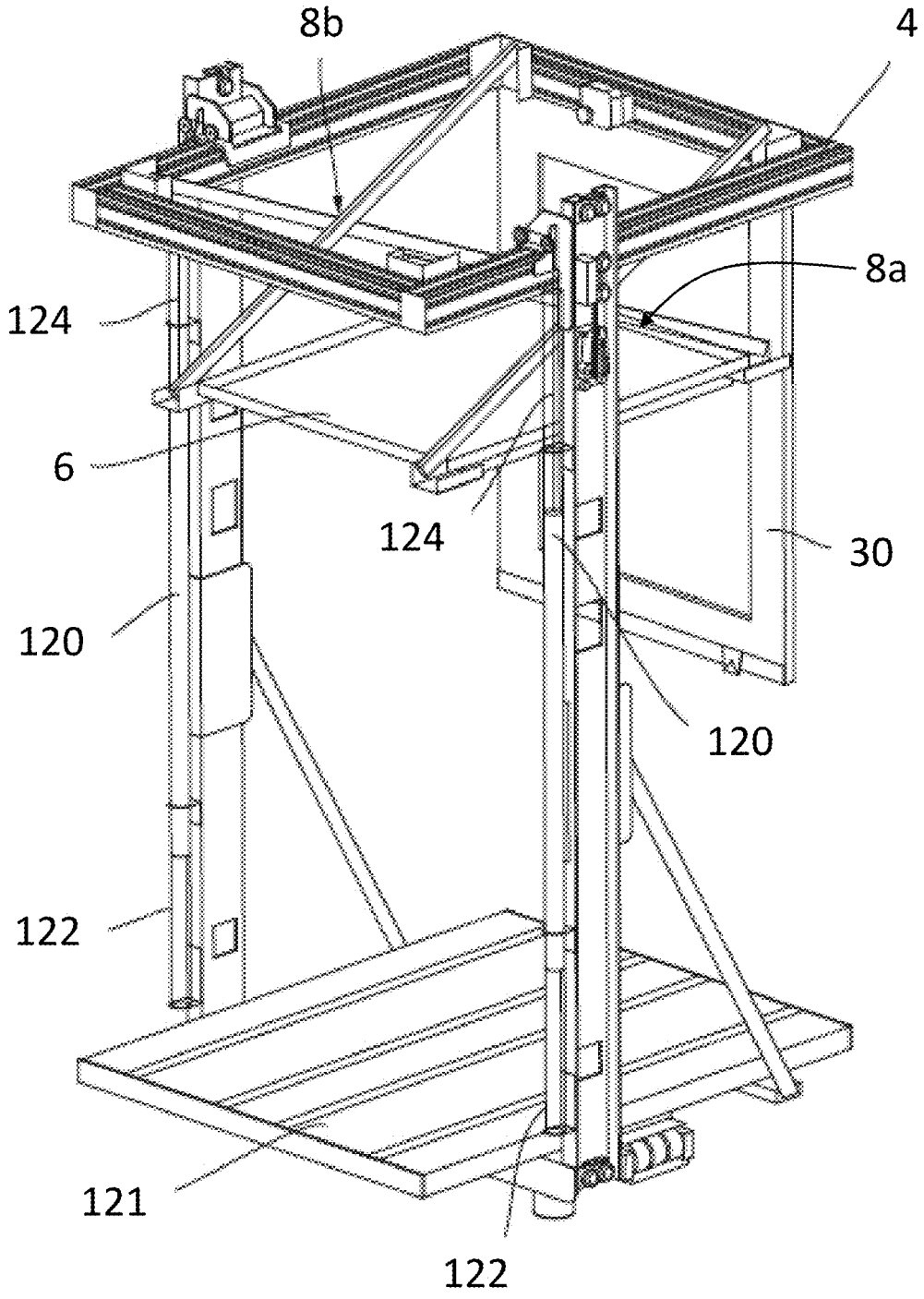
Figure 9:
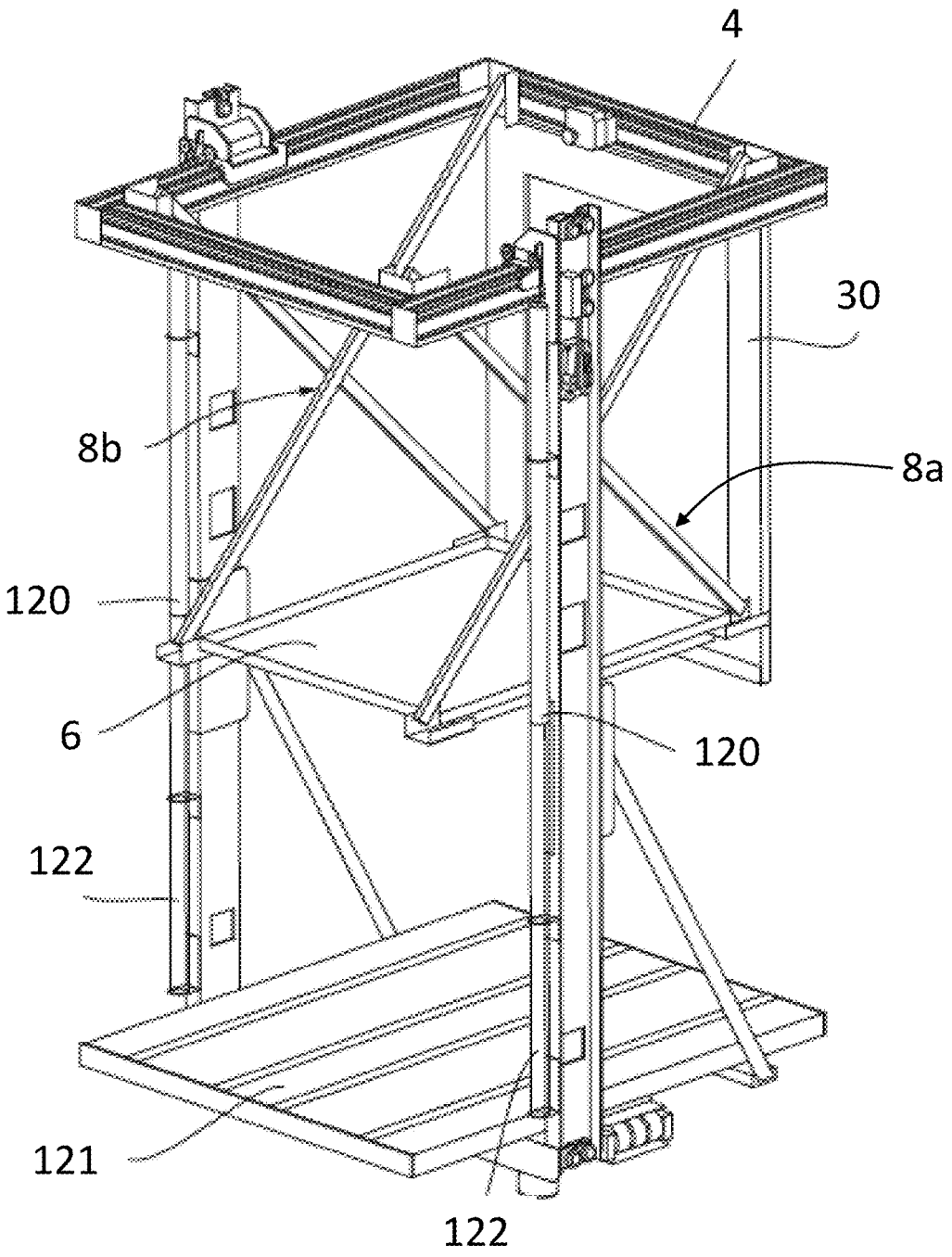
Figure 10:
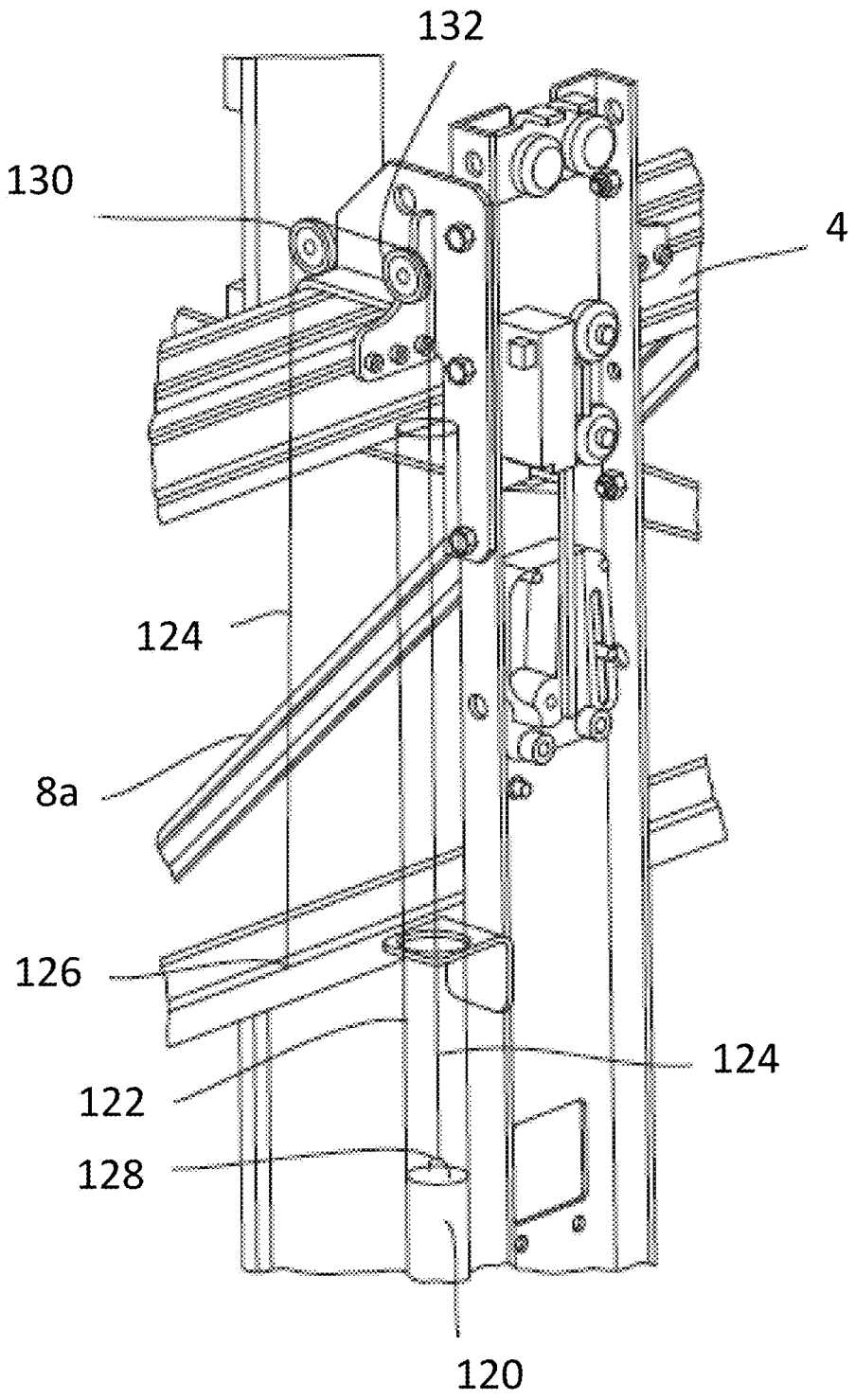
Figure 11:
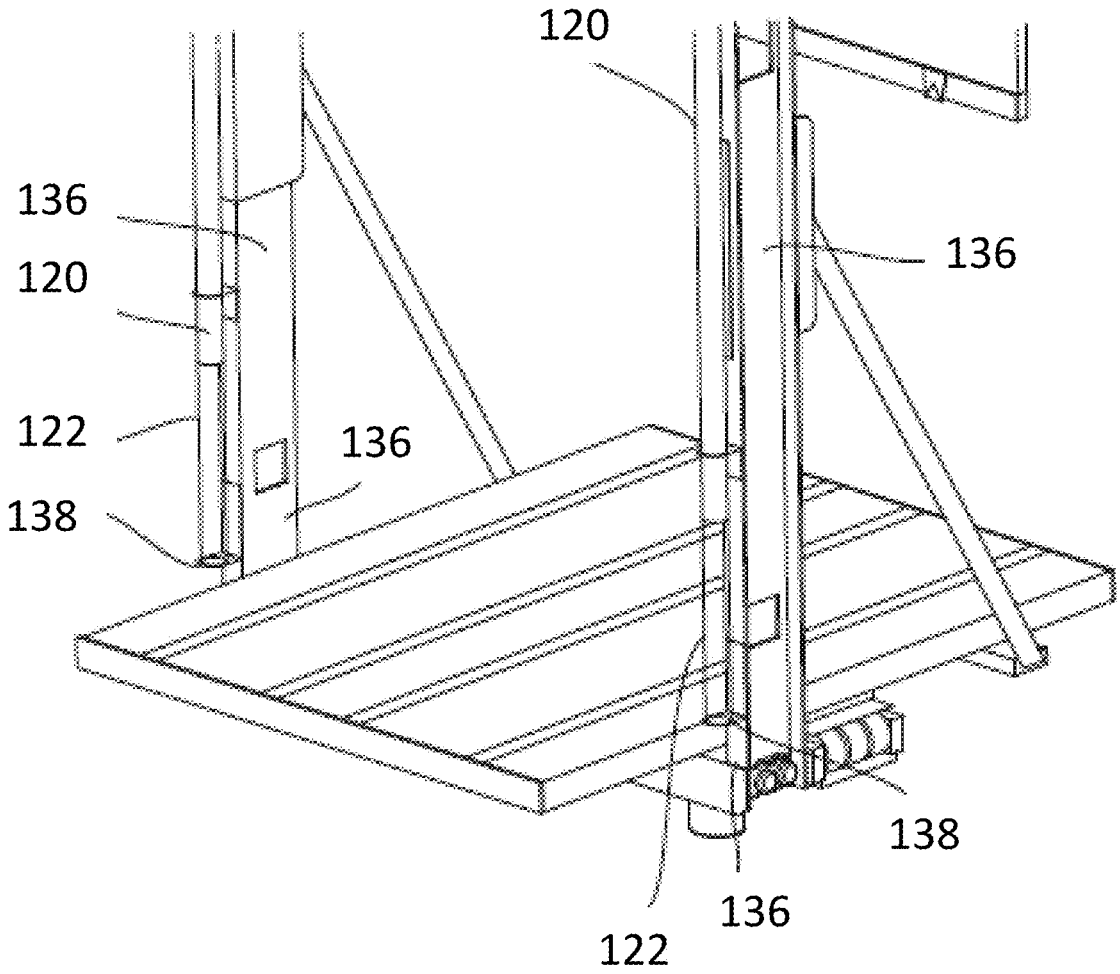
Figure 12:
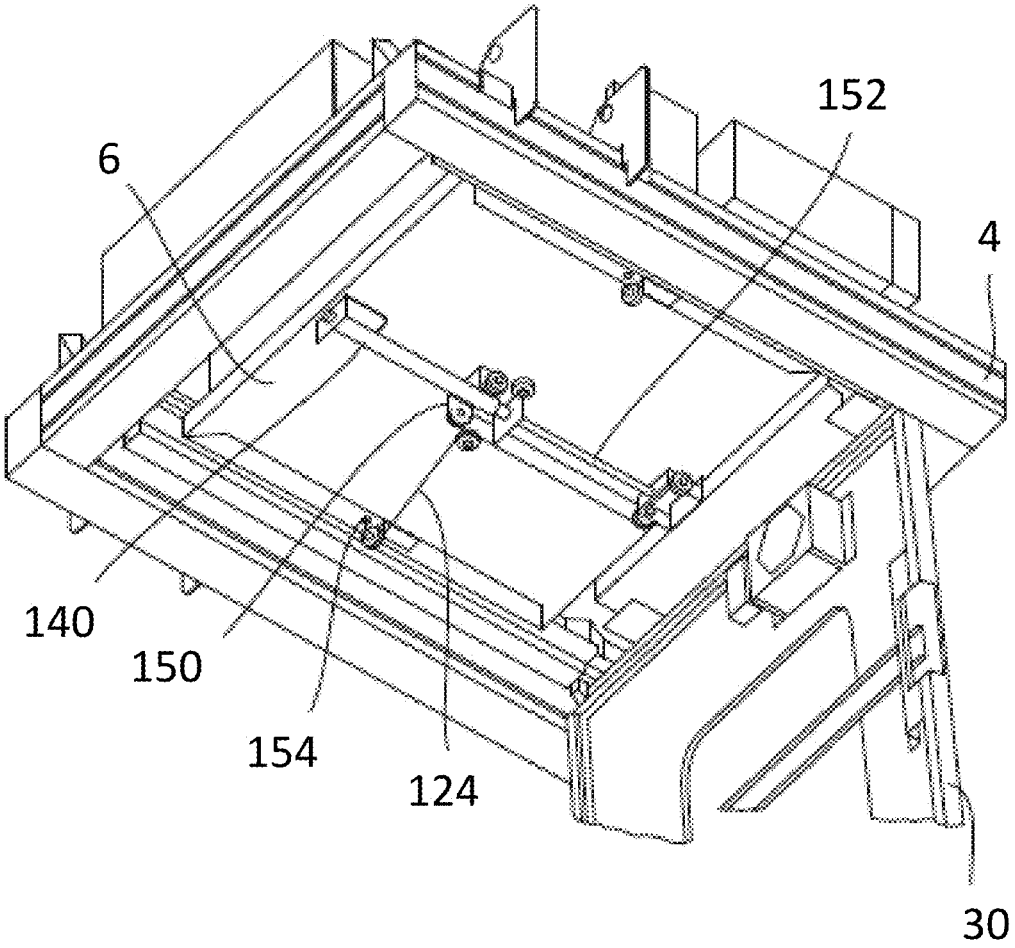
Figure 13:
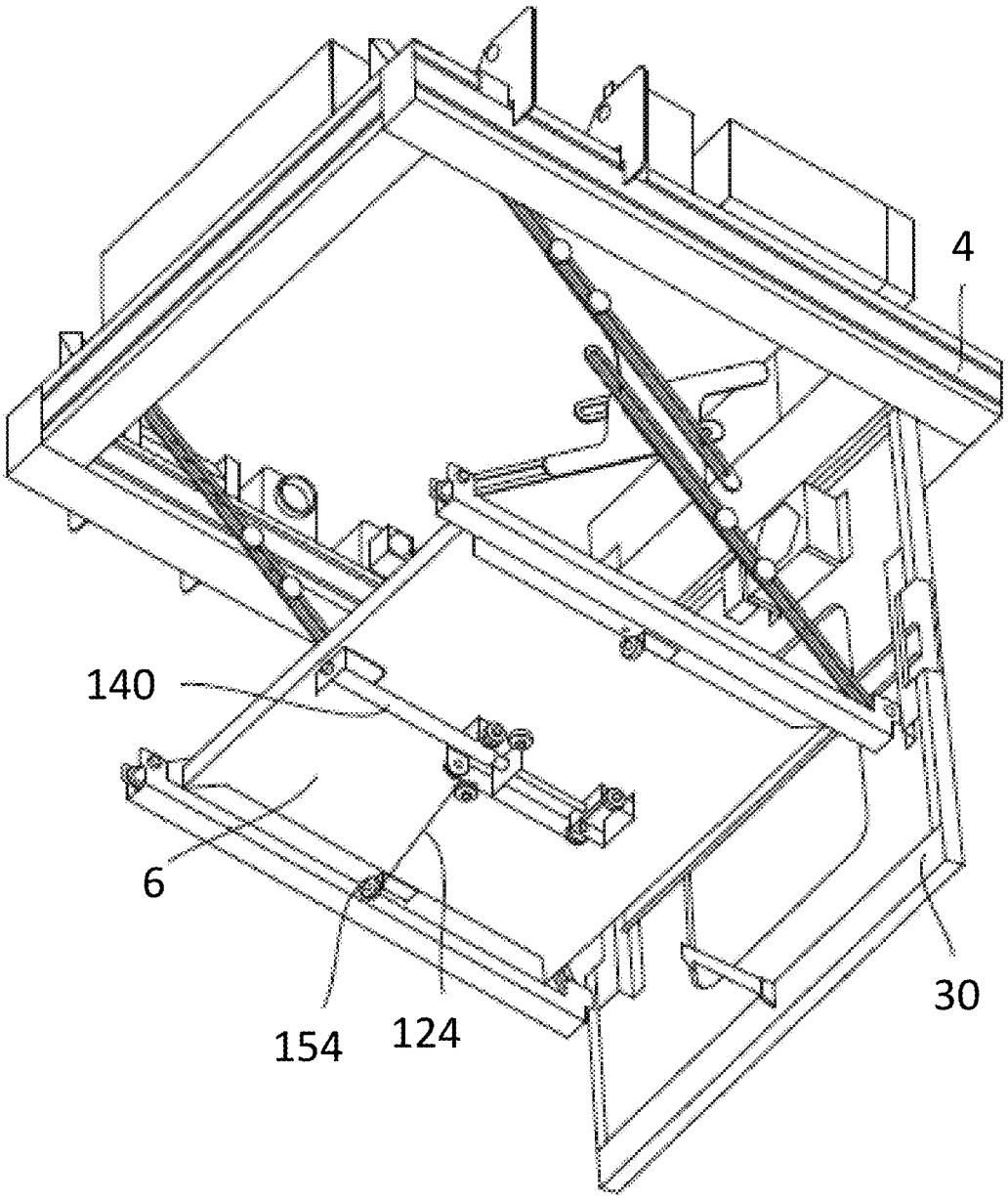
Figure 14:
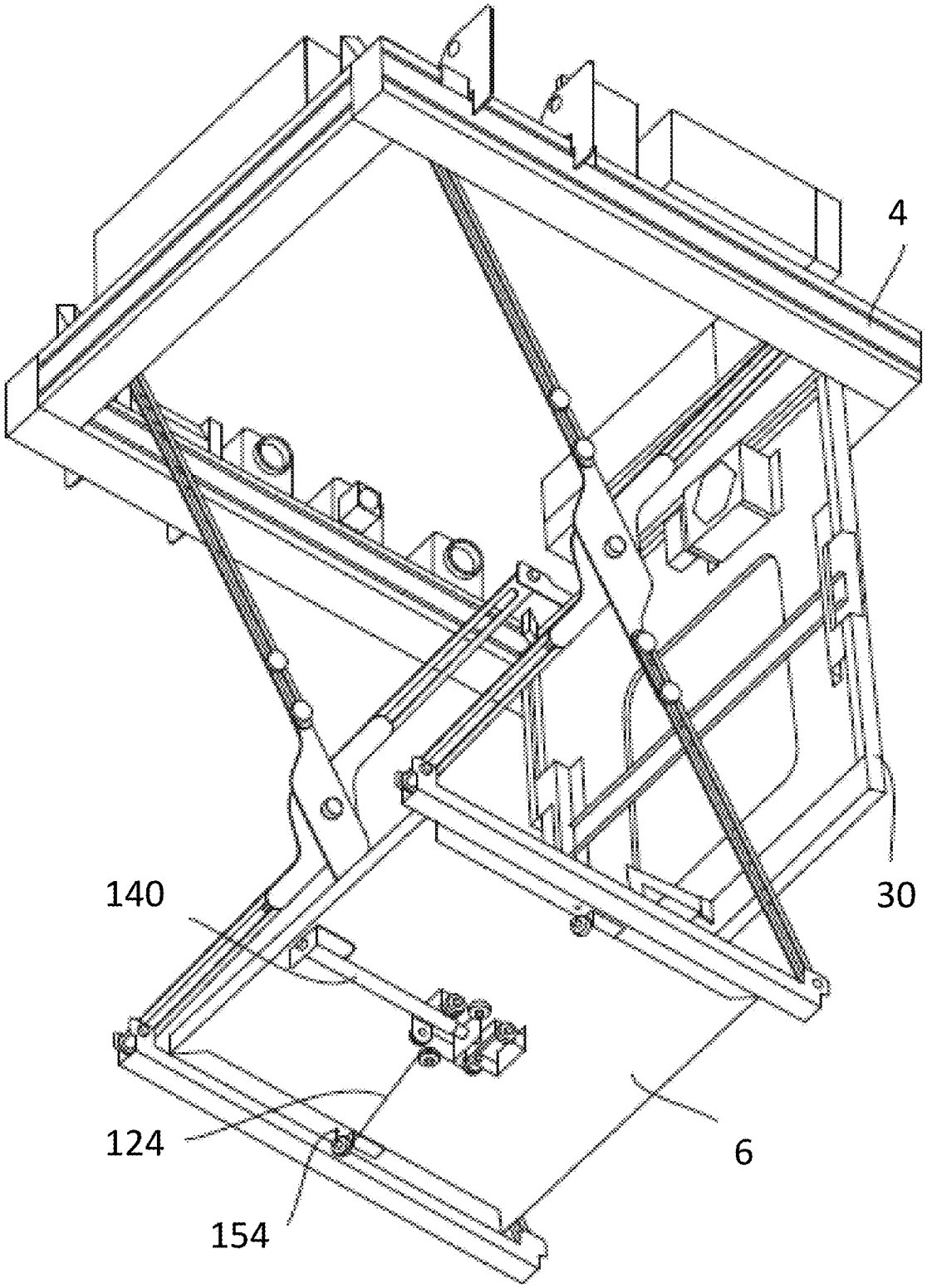
Figure 15:
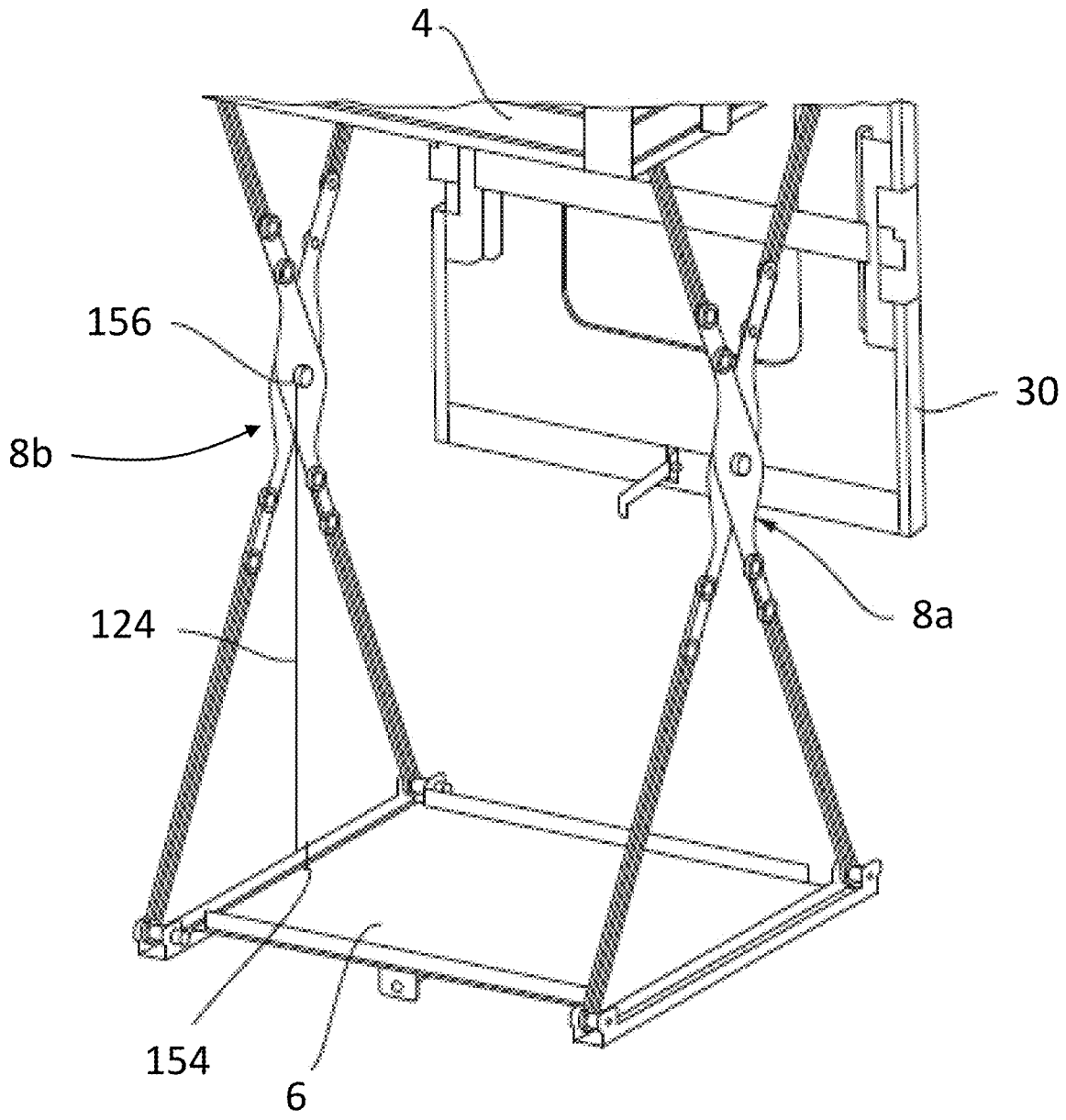
Figure 16:
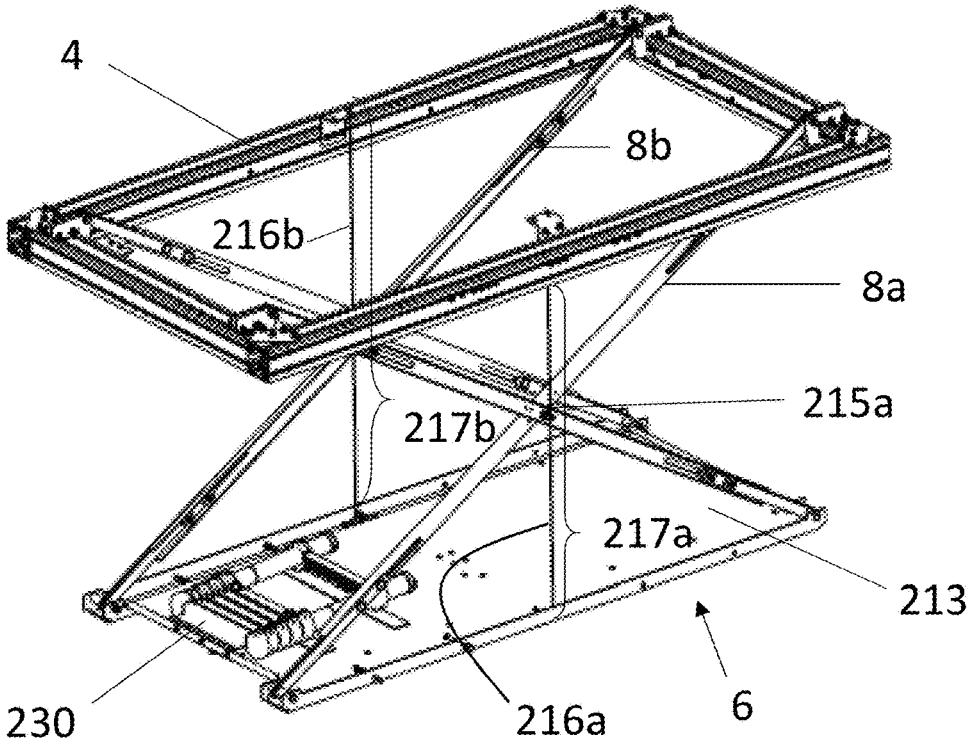
Figure 17:
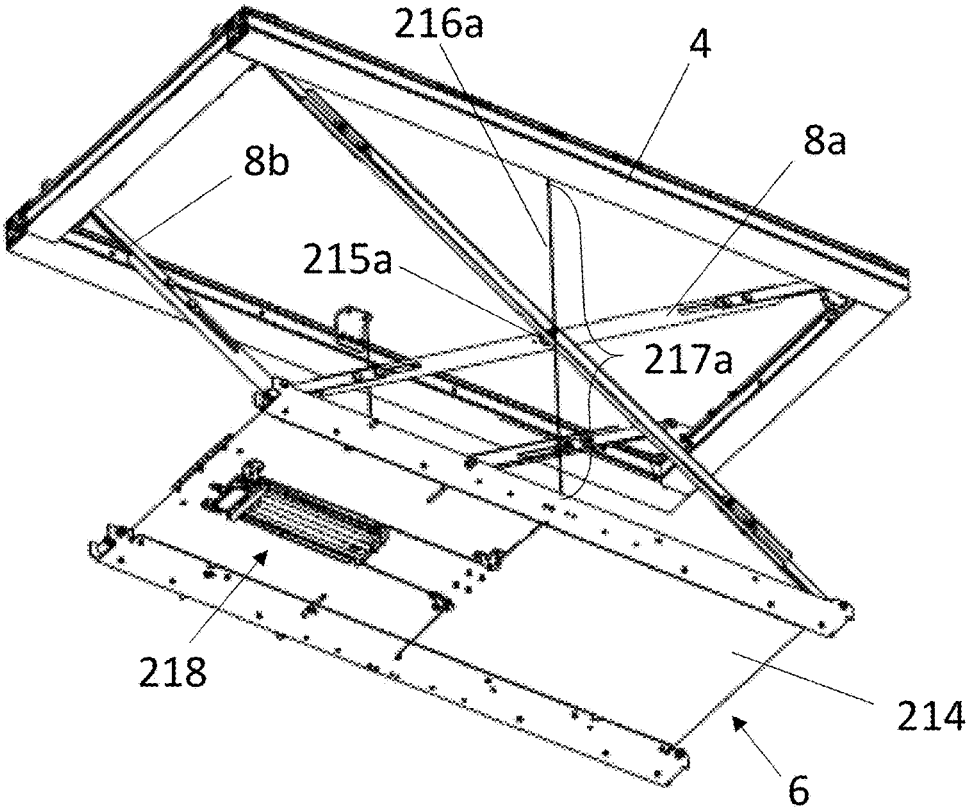
Figure 18:
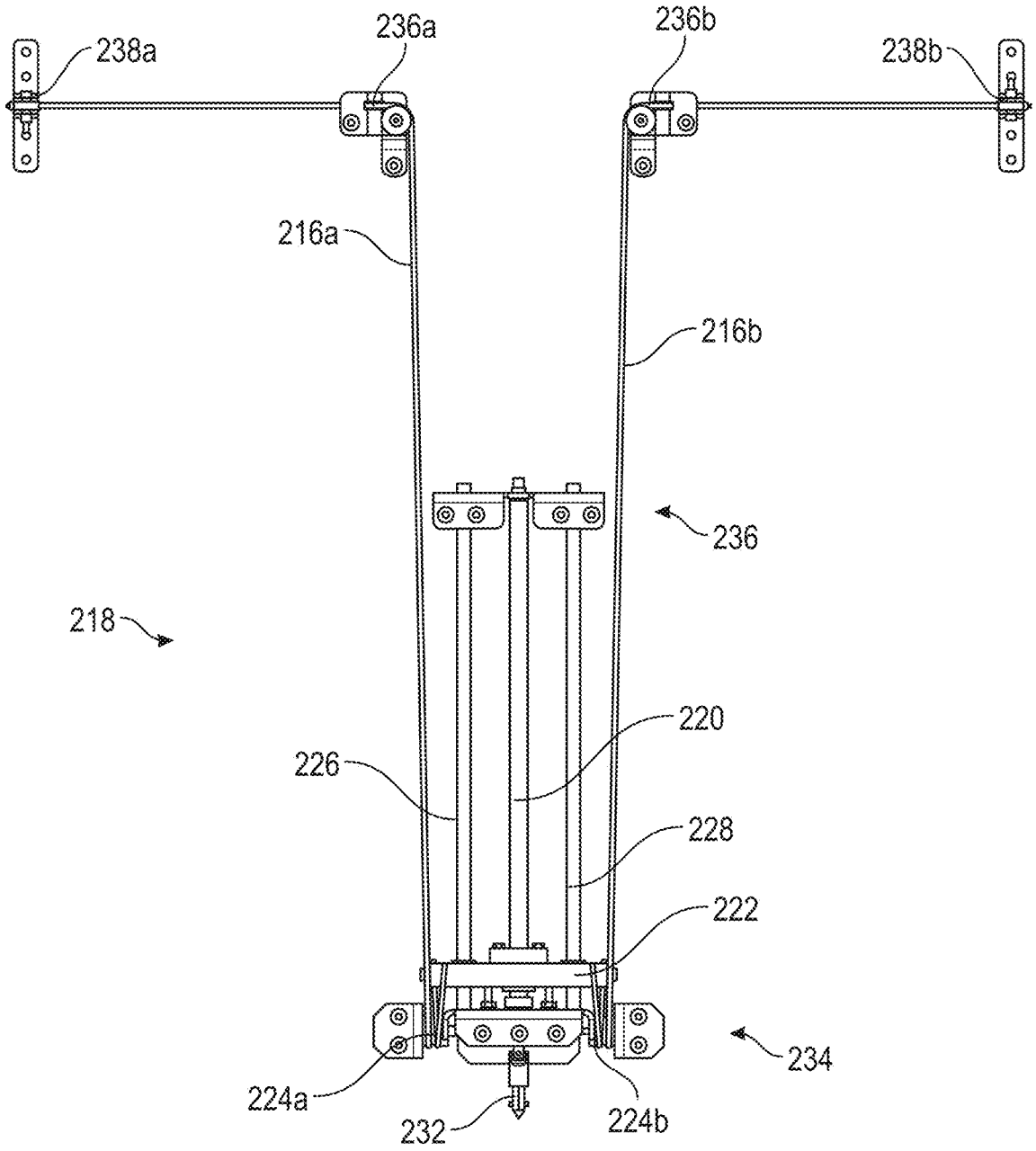
Figure 19:
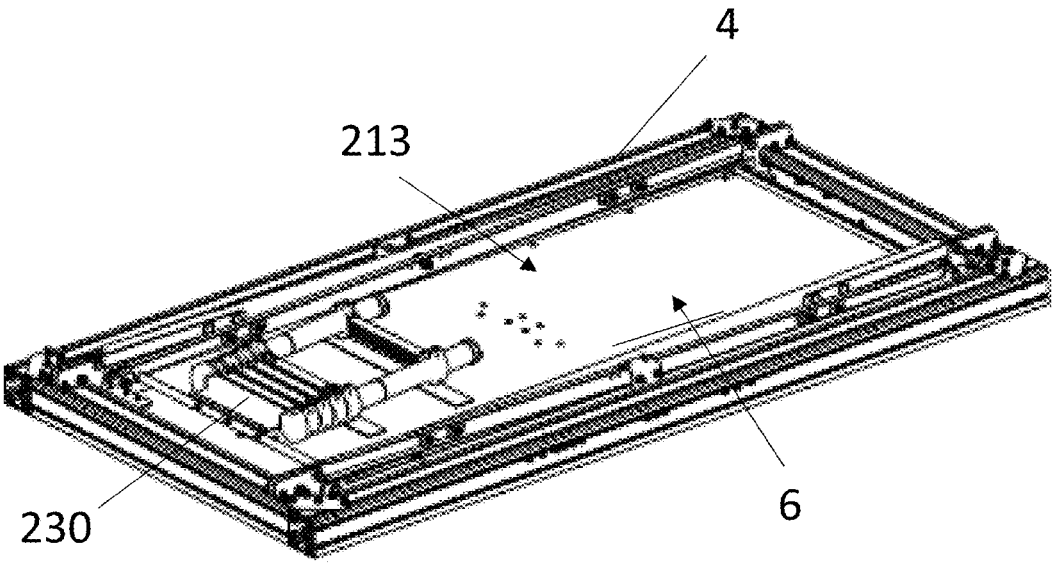
Figure 20:
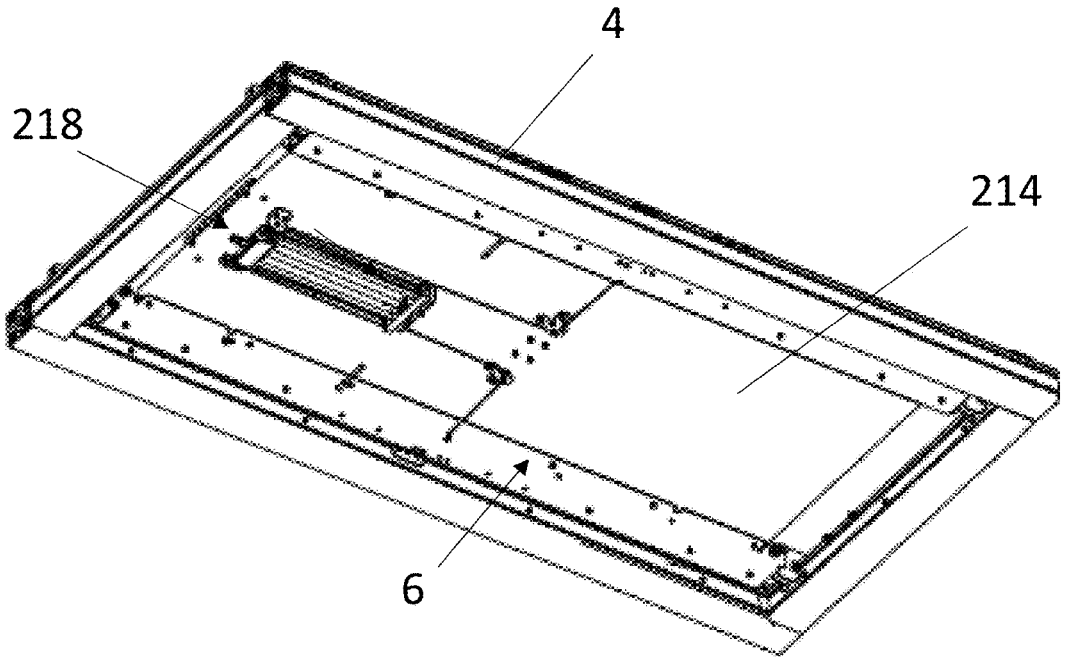
Figure 21:
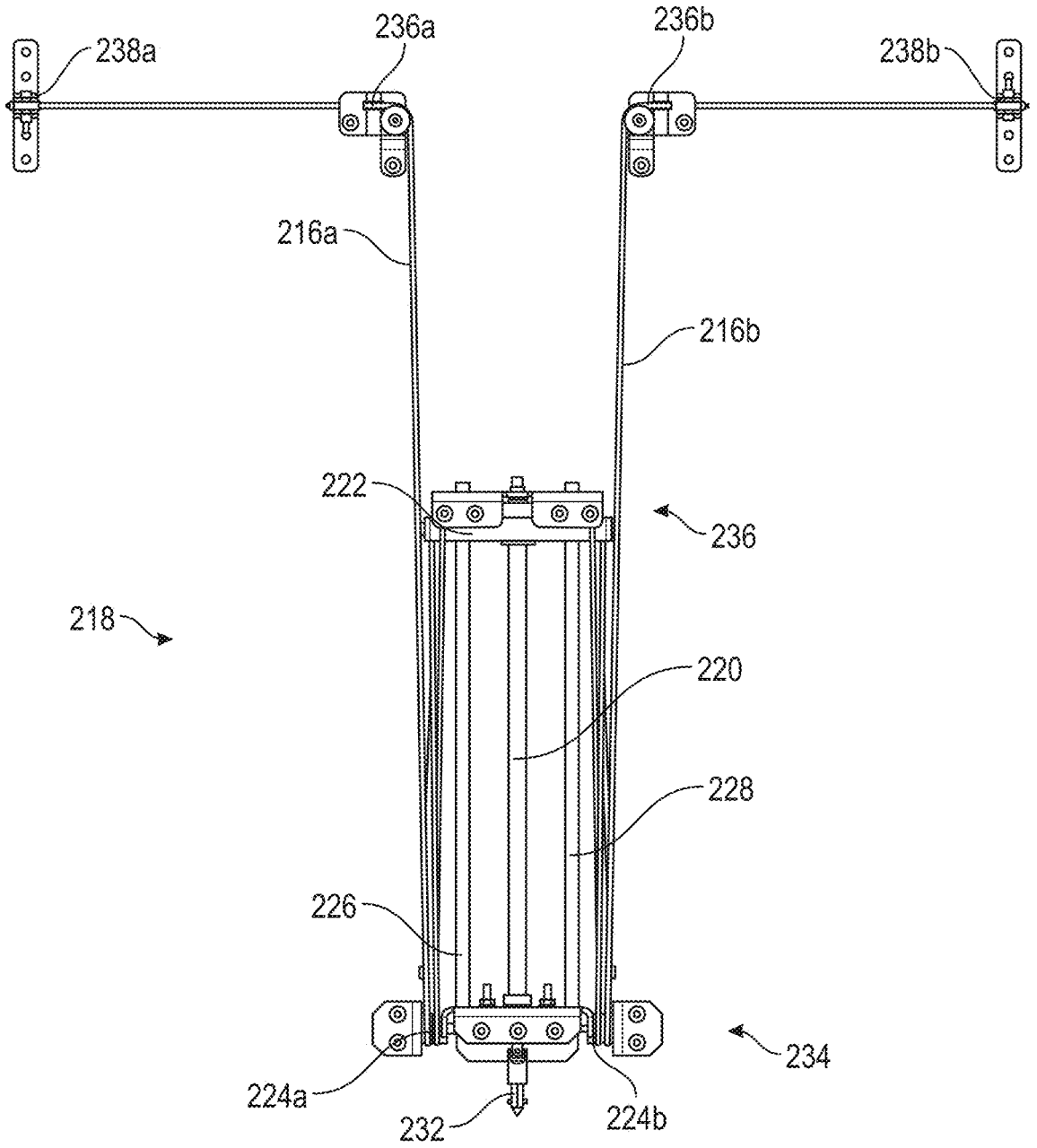
Figure 22:
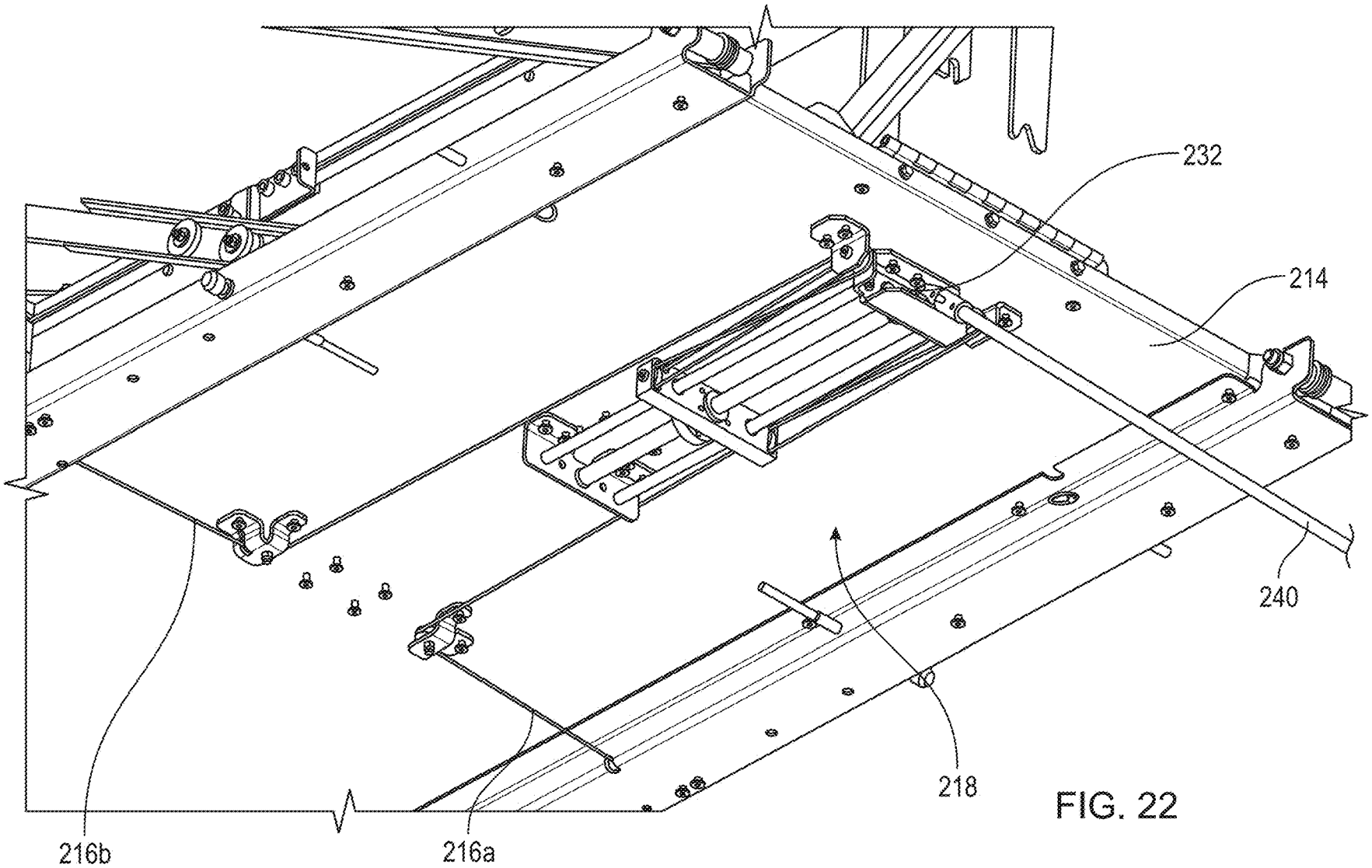
Figure 23:
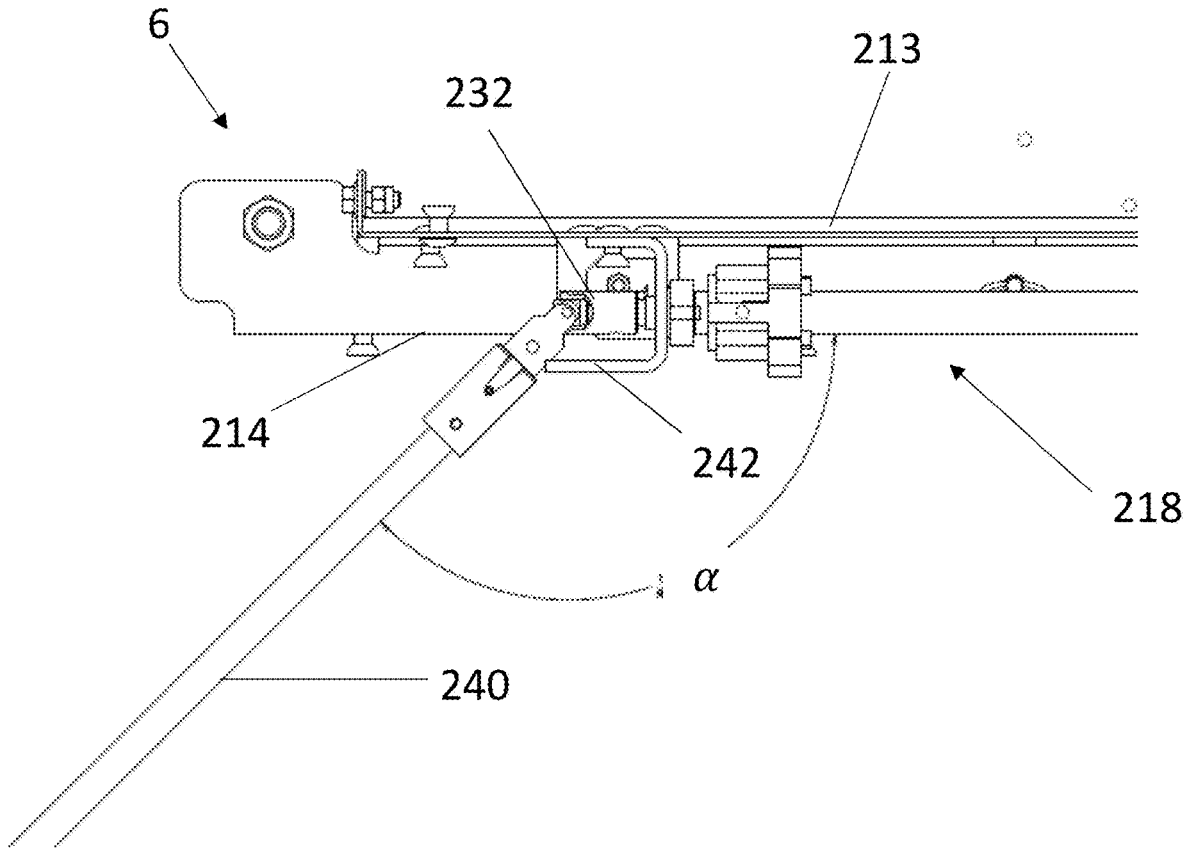
Figure 24:
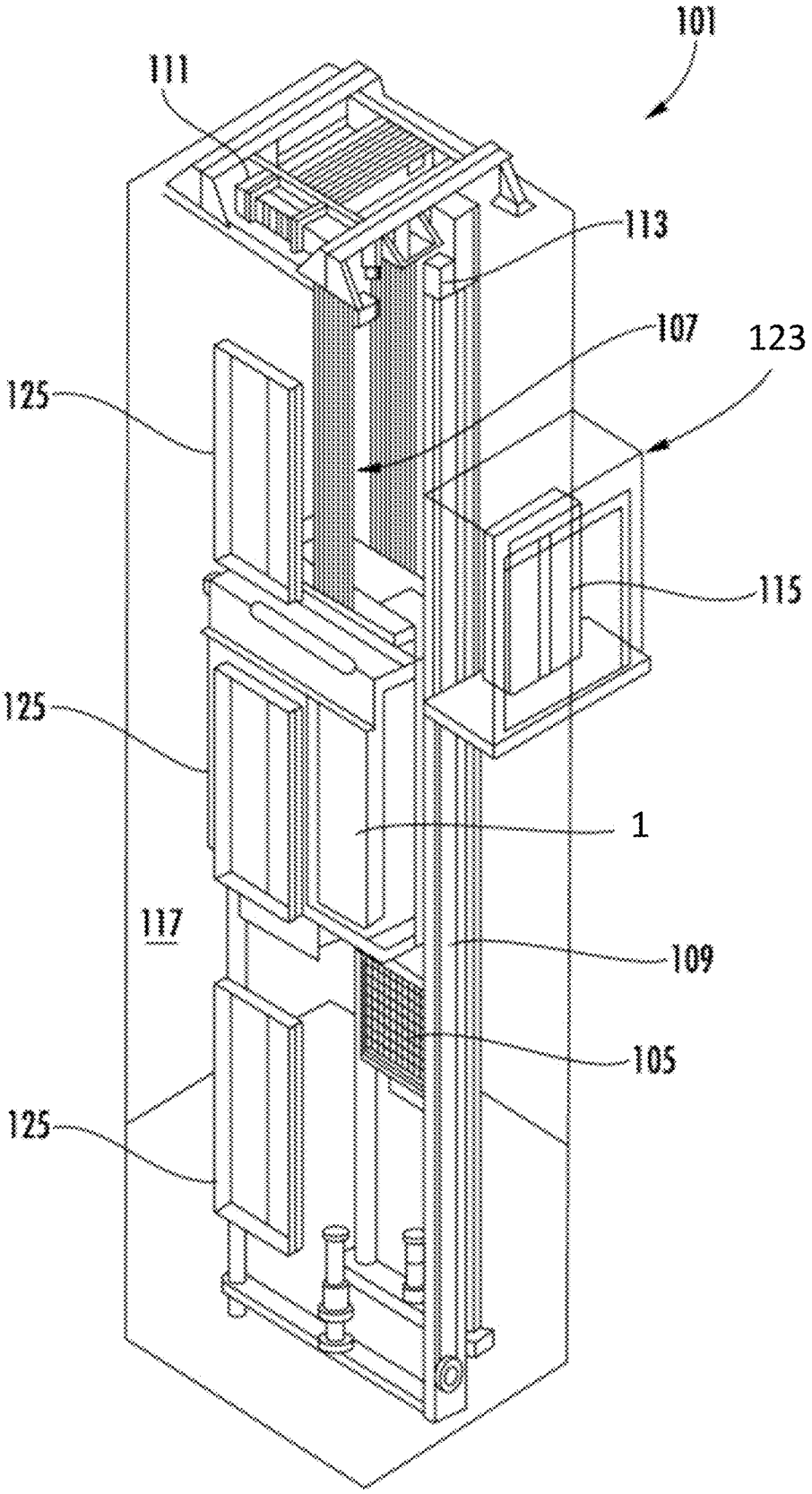

FIG. 7 shows a perspective view of some components of an elevator car and a counterforce generator according to a first example of a second aspect of the present disclosure, with the working platform in a stowed position;

FIG. 8 shows the same components as FIG. 7, with the working platform moving between the stowed position and an operational position;

FIG. 9 shows the same components as FIGS. 7 and 8, with the working platform in the operational position;

FIG. 10 is a close-up view showing how the counterforce generator is connected to the working platform by a tension member in this first example;

FIG. 11 is another close-up view of the counterforce generator in this first example;

FIG. 12 shows an underside perspective view of some components of an elevator car and a counterforce generator according to a second example of the second aspect of the present disclosure, with the working platform in a stowed position;

FIG. 13 shows the same components as FIG. 12, with the working platform moving between the stowed position and an operational position;

FIG. 14 shows the same components as FIGS. 12 and 13, with the working platform in the operational position;

FIG. 15 is close-up view showing how the counterforce generator is connected to the working platform by a tension member in this second example;

FIG. 16 is a perspective view of a working platform according to a third example of the second aspect of the present disclosure, in an operational position, in which the top surface of the working platform is visible;

FIG. 17 is a perspective view of the working platform according to this third example, in the operational position, in which a hoisting device is visible on the underside of the working platform;

FIG. 18 is a plan view of the hoisting device according to this third example of the present disclosure, when the working platform is in the operational position;

FIG. 19 is a perspective view of the working platform according to this third example of the present disclosure, in the stowed position, in which the top surface of the working platform is visible;

FIG. 20 is a perspective view of the working platform according to this third example of the present disclosure, in the stowed position, in which the underside of the working platform is visible;

FIG. 21 is a plan view of the hoisting device according to this third example of the present disclosure, when the working platform is in the stowed position;

FIG. 22 is a partial perspective view of the underside of the working platform, as the working platform is being moved between the operational position and the stowed position, by actuating the hoisting device according to this third example;

FIG. 23 is a partial side view of the working platform, including the hoisting device and an actuator, as shown in FIG. 22; and FIG. 24 is a schematic illustration of an elevator system according to various examples of the present disclosure.

DETAILED DESCRIPTION

Figure 1:
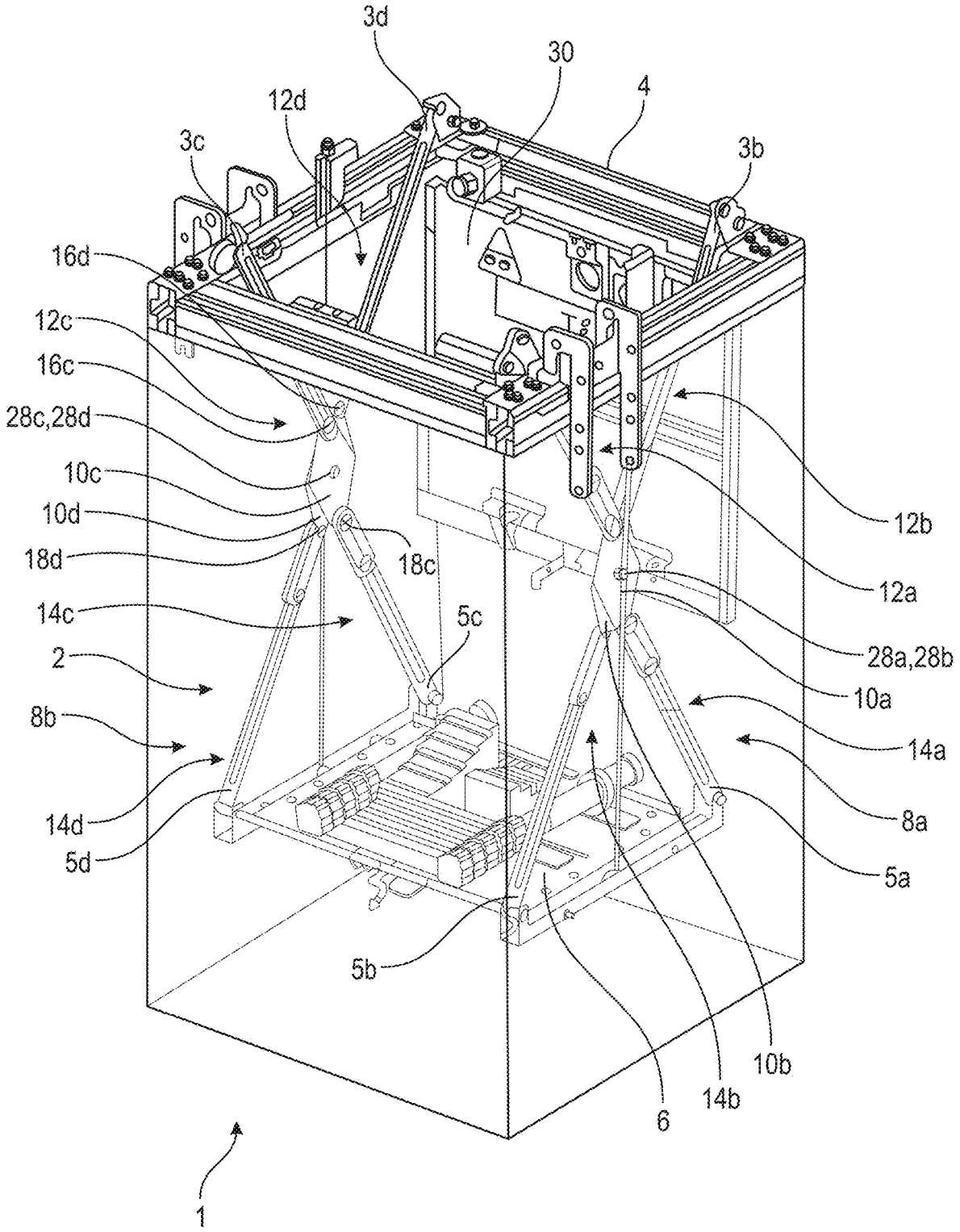
FIG. 1 shows a cutaway view of an elevator car including an extendable suspension arrangement for a working platform, according to a first aspect of the present disclosure.
Figure 4:
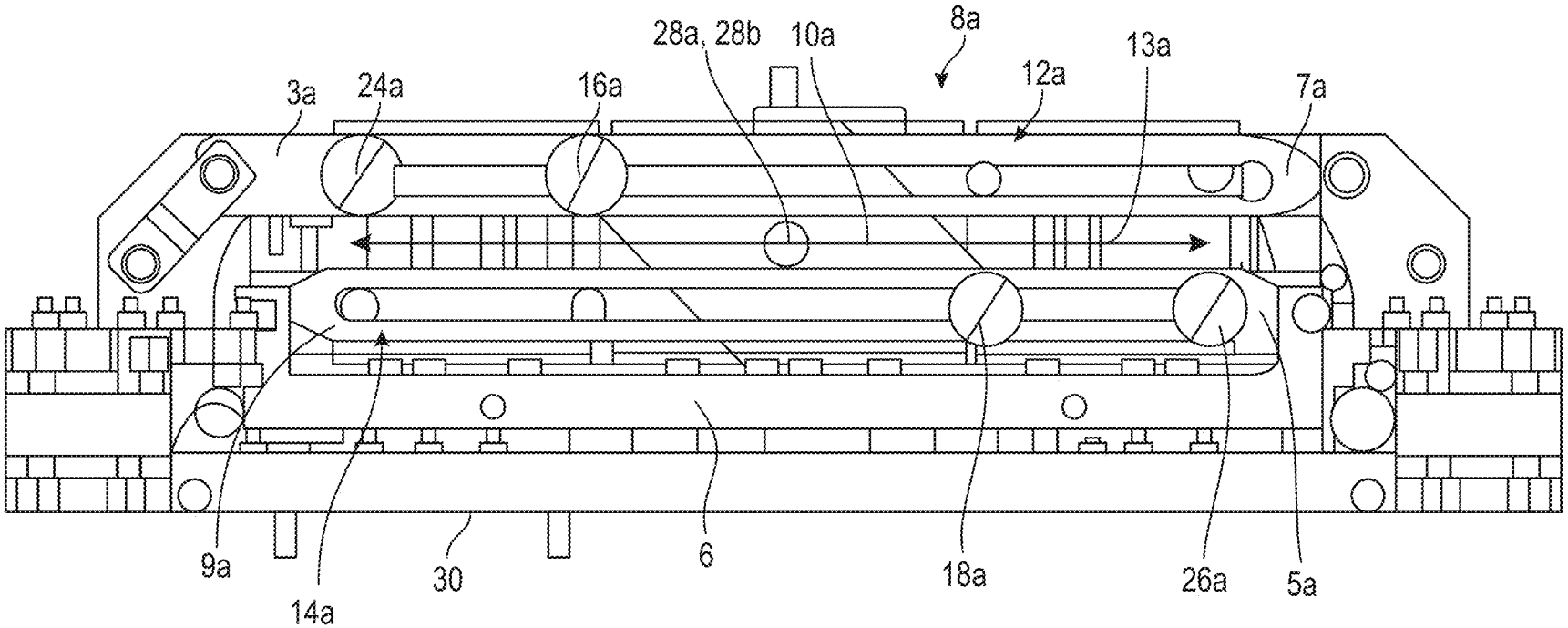
FIG. 4 shows a side view of the elevator car components shown in FIG. 2, with the working platform in the stowed position.

FIG. 1 shows an elevator car 1 which defines an interior space 2, which is suitable for accommodating passengers and/or cargo. The elevator car 1 includes a support frame 4 which is positioned above the interior space 2. The elevator car 1 also includes a working platform 6, which is moveable between a stowed position (as shown in FIG. 4), above the interior space 2, and an operational position, within the interior space 2, as is seen in FIG. 1. The working platform 6 is suspended by a first extendable suspension arrangement 8*a* and a second extendable suspension arrangement 8*b*, which, as shown, are on opposite sides of the elevator car 1 and opposite sides of the working platform 6.

As seen in FIGS. 1-6, each extendable suspension arrangement 8*a*, 8*b* includes two connection plates 10*a*, 10*b*, 10*c*, 10*d*. One of the connection plates 10*b*, 10*c* is on the inner side of the suspension arrangements 8*a*, 8*b* i.e. closer to the working platform 6, and the other connection plate 10*a*, 10*d* is on the outer side of the extendable suspension arrangement i.e. further from the working platform 6. Each connection plate 10*a*, 10*b*, 10*c*, 10*d* is slidably connected at a respective first connection point 16*a*, 16*b*, 16*c*, 16*d* to a respective first arm member 12*a*, 12*b*, 12*c*, 12*d*. Each first arm member 12*a*, 12*b*, 12*c*, 12*d* is connected at a first end 3*a*, 3*b*, 3*c*, 3*d* to the support frame 4. Similarly, each connection plate 10*a*, 10*b*, 10*c*, 10*d* is slidably connected at a respective second connection point 18*a*, 18*b*, 18*c*, 18*d* to a respective second arm member 14*a*, 14*b*, 14*c*, 14*d*. Each second arm member 14*a*, 14*b*, 14*c*, 14*d* is connected at another first end (i.e. a first end of the second arm member) 5*a*, 5*b*, 5*c*, 5*d* to the working platform 6.

Figure 2:
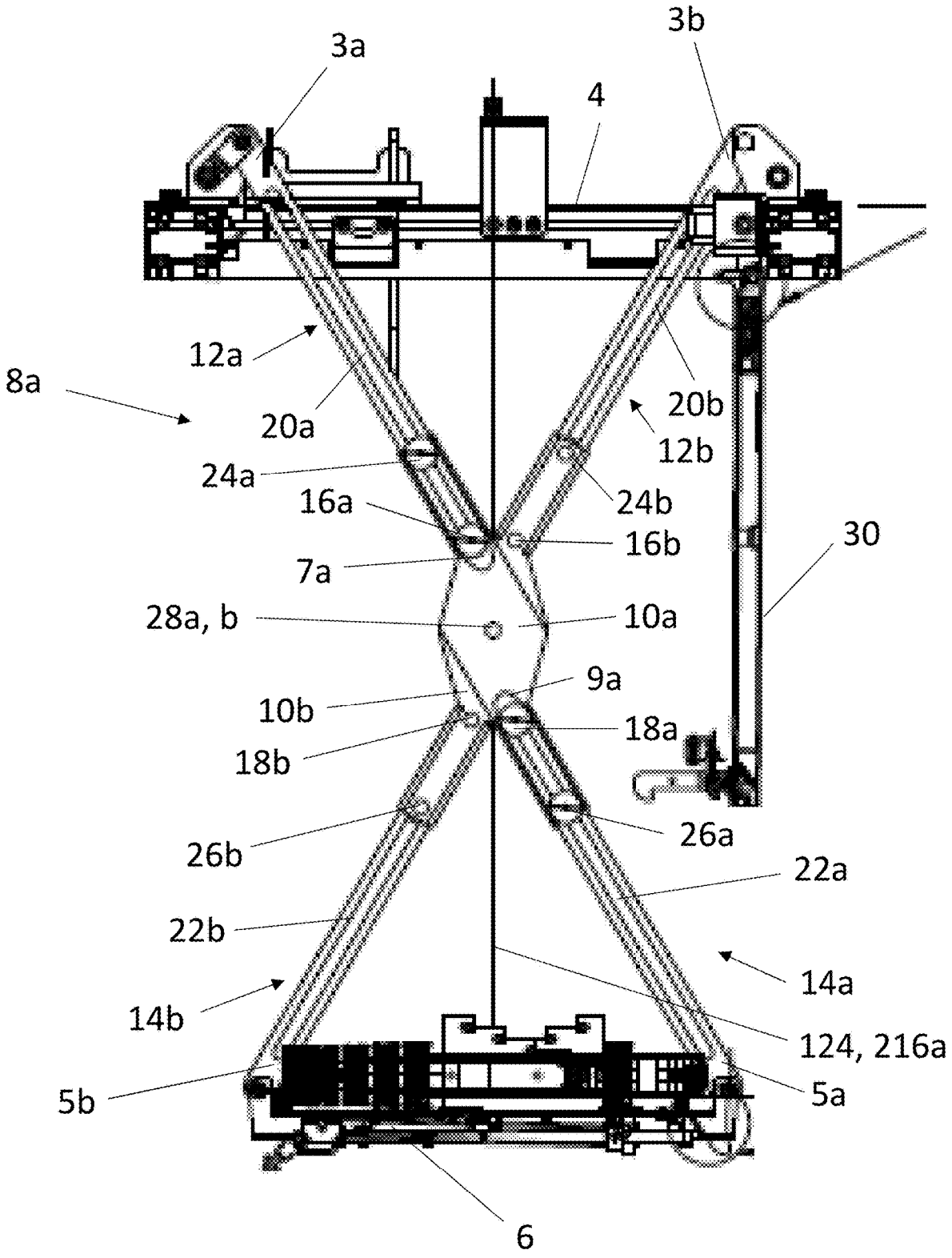
FIG. 2 shows a side view of the working platform, extendable suspension arrangement, and support frame of the elevator car of FIG. 1, with the working platform in an operational position.

A side view of some of the elevator car components, showing the extendable suspension arrangement 8*a*, but omitting the outer structure of the elevator car 1, is shown in FIG. 2. The features described herein with reference to the extendable suspension arrangement 8*a* apply likewise to extendable suspension arrangement 8*b*, although the corresponding reference numerals have been omitted. It will be understood from FIG. 1 that the pair of suspension arrangements 8*a*, 8*b* (on the left and right) are arranged to suspend the working platform 6 from the support frame 4 in the operational position seen in FIG. 2.

As can be seen in FIG. 2, each of the first arm members 12*a*, 12*b* comprises a slot 20*a*, 20*b* and each of the second arm members 14*a*, 14*b* comprises a slot 22*a*, 22*b*. Each slot 20*a*, 20*b*, 22*a*, 22*b* extends along substantially the entire length of the first arm member 12*a*, 12*b* and the second arm member 14*a*, 14*b* respectively. Each connection plate 10*a*, 10*b* includes a first projection 16*a*, 16*b* (providing a first connection point) and a second projection 24*a*, 24*b* both configured to slide in the slots 20*a*, 20*b* of the first arm members 12*a*, 12*b*. Similarly, each connection plate 10*a*, 10*b* includes another first projection 18*a*, 18*b* (providing a second connection point), and another second projection 26*a*, 26*b* and both configured to slide in the slots 22*a*, 22*b* of the second arm members 14*a*, 14*b*. Thus the respective first projections 16*a*, 18*a* and second projections 24*a*, 26*a* of the first and second arm members 12*a*, 14*a* define a sliding direction along which the first arm member 12*a* and the second arm member 14*a* are arranged to slide. This sliding direction can be seen in FIG. 6*b* and is described in more detail below. In a similar way, the respective first projections 16*b*, 18*b* and second projections 24*b*, 26*b* of the first and second arm members 12*b*, 14*b* define a sliding direction along which the first arm member 12*b* and the second arm member 14*b* are arranged to slide.

Each connection plate 10*a*, 10*b* comprises a pivot point 28*a*, 28*b*. The first connection plate 10*a* and the second connection plate 10*b* of the extendable suspension arrangement 8*a* (and similarly the extendable suspension arrangement 8*b*) are attached together at their respective pivot points 28*a*, 28*b* so as to rotate relative to each other about this shared pivot point 28*a*, 28*b*. As can be seen, the pivot point 28*a*, 28*b* is located centrally between the first connection point 16*a*, 16*b* and the second connection point 18*a*, 18*b*, both along the sliding direction, and perpendicular to the sliding direction. As the first connection plate 10*a* rotates relative to the second connection plate 10*b*, the sliding directions of each corresponding set of first and second arm members 12*a*, 12*b*, 14*a*, 14*b* likewise rotate about the shared pivot point 28*a*, 28*b*. This can be appreciated by comparing FIGS. 2 and 3.

The elevator car 1 optionally further includes a cover panel 30, which is configured to cover the working platform 6 when the working platform 6 is in the stowed position, as shown in FIG. 4.

As the working platform 6 is moved between the operational position (seen in FIG. 2) and the stowed position (seen in FIG. 4), the first connection plate 10*a*, 10*d* and second connection plate 10*b*, 10*c* rotate relative to each other i.e. in opposite directions (and thus the sliding directions of the pairs of arms also rotate relative to each other). At the same time, the first arm member 12*a*, 12*b*, 12*c*, 12*d* and the second arm member 14*a*, 14*b*, 14*c*, 14*d* slide parallel to each other, along a sliding direction, as can be seen with reference to FIGS. 2, 3 and 4, which show the stages as the working platform 6 moves from the operational position to the stowed position. The sliding direction is fixed relative to the connection plate, as described with reference to the later Figures, but as the connection plate rotates, so too does the sliding direction. As can be seen in the side view of FIG. 2, the first connection point 16*a*, 16*b* and the second connection point 18*a*, 18*b* have an offset from one another in a direction perpendicular to the sliding direction. In the example shown, the first connection point 16*a*, 16*b* and the second connection point 18*a*, 18*b* also have an offset from one another along the sliding direction. These offsets are described in more detail below, with reference to FIG. 6*b*.

By connecting the first and second arm members 12*a*, 12*b*, 14*a*, 14*b* slidably to the connection plates 10*a*, 10*b*, 10*c*, 10*d* with an offset between the first and second connection points 16*a*, 16*b*, 18*a*, 18*b*, an extendable suspension arrangement 8*a* is provided which has both a long range of extension between the stowed and operational positions, and also a compact footprint when not extended.

When the working platform 6 is in the operational position, as shown in FIG. 2, a second end 7*a* of the first arm member 12*a* is pulled away from a second end 9*a* of the second arm member 14*a*, providing a long range of extension for the the extendable suspension arrangement 8*a*, thereby allowing the working platform 6 to be lowered to a desired height within the interior space 2 of the elevator car 1.

Figure 3:
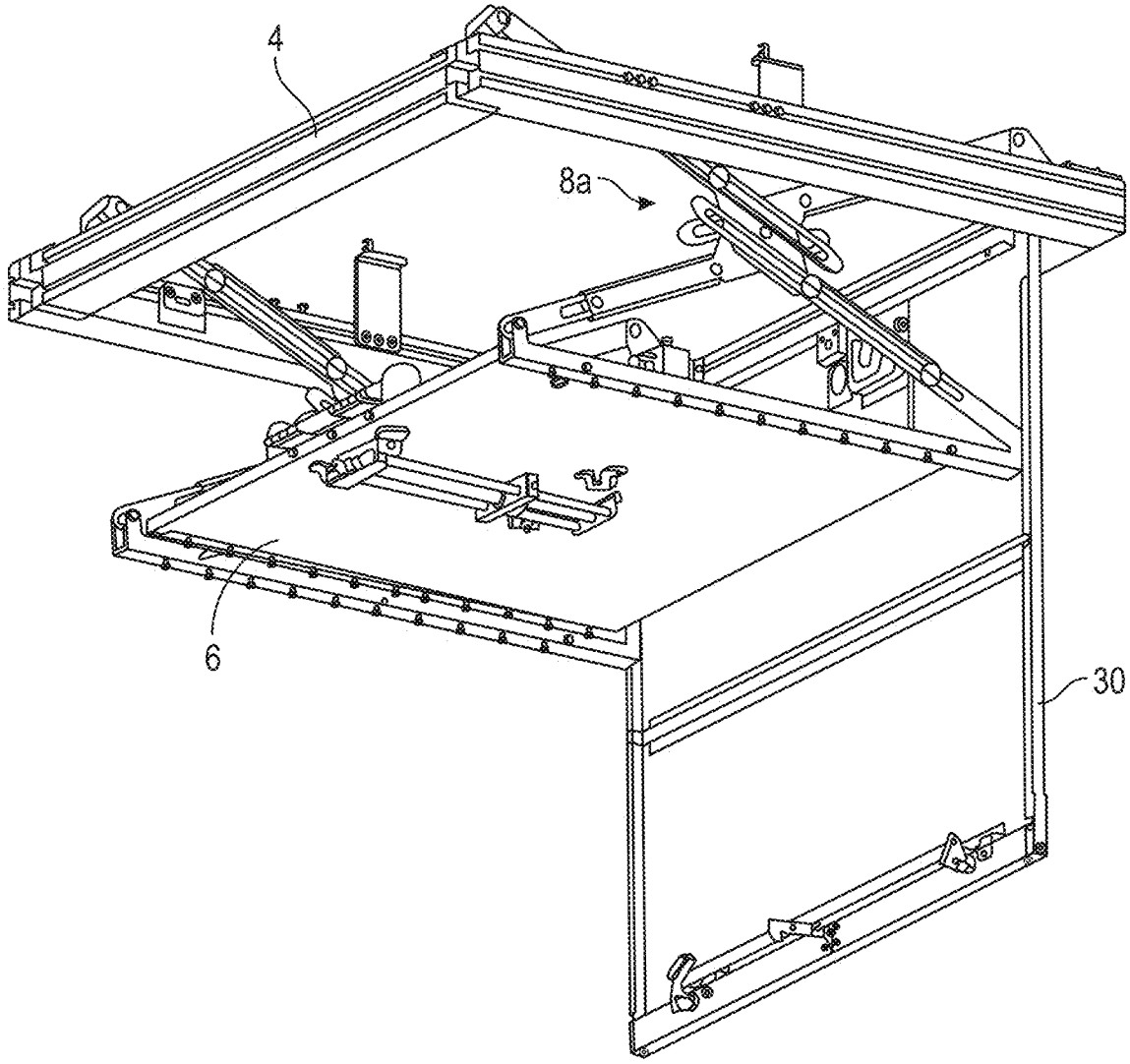
FIG. 3 shows a perspective view of the elevator car components shown in FIG. 2, with the working platform moving between a stowed position and the operational position.

As the working platform 6 is moved from the operational position (seen in FIG. 2) to the stowed position (seen in FIG. 4) the first arm member 12*a*, 12*b*, 12*c*, 12*d* and the second arm member 14*a*, 14*b*, 14*c*, 14*d* slide relative to the connection plate 10*a*, 10*b*, 10*c*, 10*d*, as seen in FIG. 3, and the connection plates 10*a*, 10*b* rotate in opposite directions about the shared pivot point 28*a*, 28*b*.

When the working platform 6 is in the stowed position, as shown in FIG. 4, the first end 3*a* of the first arm member 12*a*, 12*b* is adjacent to the second end 9*a* of the second arm member 14*a*, 14*b* and the first end 5*a* of the second arm member 12*a*, 12*b* is adjacent to the second end 7*a* of the second arm member 14*a*, 14*b*. As seen in FIG. 4, due to the offset along the sliding direction of the first and second connection points 16*a*, 18*a*, 24*a*, 26*a*, the first arm member and the second arm member 12*a*, 14*a* slide into a "stacked" position, in which they overlap along the sliding direction 13*a*. Furthermore, due to the pivoting of the connection plates 10*a*, 10*b*, the first and second arm members 12*a*, 14*a* rotate (whilst sliding) to sit in a substantially horizontal position (as defined relative to the elevator car 2) above the working platform 6 in the stowed position, as seen in FIG. 4.

The arrangement of the connection plates 10*a*, 10*b* and first and second arm members 12*a*, 12*b*, 14*a*, 14*b* is shown in more detail in the view of FIG. 5, and in the exploded view of FIG. 6*a*. FIG. 6*b* shows a single exemplary connection plate 10*a*. Throughout this description, each reference numeral is followed by either "a" or "b". These reference numerals refer to like components, with the additional "a" and "b" indicating that this component is part of the first extendable suspension arrangement 8*a*, respectively the outer and inner parts of the first extendable suspension arrangement 8*a*. Likewise, although not included in FIGS. 2-6, the statements made herein apply likewise to the components of the second extendable suspension arrangement 8*b* seen in FIG. 1, respectively the inner and outer parts of the second extendable suspension arrangement 8*b*, labelled elsewhere with "c" and "d". The terms "a" and "b", are used in the following description for clarity, but it will be understood by the skilled person that these statements may apply likewise to the second extendable suspension arrangement 8*b* having components followed by "c" and "d".

As shown, the exemplary extendable suspension arrangement 8*a* includes a first arm member 12*a*, 12*b*, having a slot 20*a*, 20*b*, and a second arm member 14*a*, 14*b*, having a second slot 22*a*, 22*b*. Each connection plate 10*a*, 10*b* comprises four projections, 16*a*, 16*b*, 18*a*, 18*b*, 24*a*, 24*b*, 26*a*, 26*b*. The projections 16*b*, 18*b*, 24*b* and 26*b* are visible only from their rear side in the view shown in FIG. 5, and project from the side of the connection plate 10*b* which is not seen in FIG. 5 i.e. into the page. There are a first projection 16*a*, 16*b* and a second projection 24*a*, 24*b* arranged to move in the slot 20*a*, 20*b* of the first arm member 12*a*, 12*b*, to form a sliding connection. There are similarly a first projection 18*a*, 18*b* and a second projection 26*a*, 26*b*, arranged to move in the slot 22*a*, 22*b* of the second arm member 14*a*, 14*b*, to form a sliding connection. For a given extendable suspension arrangement 8*a* there is a first set including a connection plate 10*a*, a first arm member 12*a*, a second arm member 14*a*, and there is then a second set including a connection plate 10*b*, a first arm member 12*b* and a second arm member 14*b* (and likewise for "c" and "d"). The connection plates 10*a*, 10*b* of these "sets" each have a central pivot point 28*a*, 28*b* about which the connection plates 10*a*, 10*b* rotate as the extendable suspension arrangement 8*a* extends when the working platform 6 moves between the stowed position and the operational position. The connection plates 10*a*, 10*b* of the extendable suspension arrangement 8*a* are arranged to rotate in opposite directions to one another. The connection plates 10*a*, 10*b* are joined at these pivot points 28*a*, 28*b* to form a kind of scissor mechanism.

These two "sets" are shown more clearly in a blown-apart view in FIG. 6*a*. The reference numerals followed by "a" and "b" have been used as an example, but this applies equally to the components "c" and "d". It can be seen that each of the projections 16*a*, 18*a*, 24*a*, 26*a* is formed by an arrangement of a nut and bolt, placed on opposing sides of the slots 20*a*, 20*b*, 22*a*, 22*b* and fastened together, in this example. Each projection 16*a*, 18*a*, 24*a*, 26*a* additionally includes two washers, to improve the smoothness of sliding. Additionally it can be seen that the pivot points 28*a*, 28*b* are attached together by a nut and bolt, passing through a respective hole on each plate 10*a*, 10*b*. Washers are again included, to assist in smooth rotation. Of course, other examples could omit such a nut and bolt fastening and instead rely on projections formed on the surfaces of the connection plates 10*a*, 10*b* to slide in the slots 20*a*, 20*b*, 22*a*, 22*b*, or a combination of these two approaches could be used.

The first projection 16*a* forms a first connection point which is fixed relative to the connection plate 10*a*. The first projection 16*a* together with the second projection 24*a* defines a sliding direction 13*a* for the first arm member 12*a*. Similarly the first projection 18*a* forms a second connection point which is also fixed relative to the connection plate 10*a*, and together the first and second projections 18*a*, 26*a* define a sliding direction 13*a* for the second arm member 14*a*, which is parallel to the sliding direction 13*a* of the first arm member 12*a*. This ensures that the first arm member 12*a* and the second arm member 14*a* do not converge as they slide.

The sliding direction 13*a* is seen more clearly in FIG. 6*b*, which shows a single connection plate 10*a* (although this could equally be one of the other connection plates 10*b*, 10*c*, or 10*d*). The first arm member and the second arm member (not shown) slide along the parallel sliding directions 13*a*. As seen in FIG. 6*b*, the first projection 16*a*, forming the first connection point, and the second projection 18*a*, which forms the second connection point, are offset from each other by a total offset 15*a*.

The total offset 15*a* is made up of two different components. There is a first offset component 17*a*, which is an offset along a direction that is perpendicular to the sliding direction 13*a* of the first and second arm members. The offset 17*a* along this direction allows the first and second arm members to slide along their lengths without contacting each other. There is also a second offset component 19*a*, which is an offset along the sliding directions 13*a*. The offset 19*a* along the sliding directions 13*a* increases the total length of the extendable suspension arrangement when both the first arm member and the second arm member are fully "extended" i.e. slid as far as possible away from each other.

The first and second connection points 16*a*, 18*a* are fixed relative to the connection plate 10*a*, so the sliding direction 13*a* is constant with respect to the connection plate 10*a*. However, as described above, the connection plate 10*a* is arranged to pivot around the pivot point 28*a* as the extendable suspension arrangement extends or contracts, so that as the working platform is moved between the stowed and operational positions, the connection plate 10*a* rotates. Therefore, during this movement, the sliding direction 13*a* itself rotates with respect to the frame of reference of the elevator car 1.

As described above, in some examples, the elevator car further comprises a counterforce generator, configured to provide a counterforce acting against the weight of the working platform, and a tension member.

In a first set of examples, as shown in FIGS. 7-11, the counterforce generator comprises a set of counterweights 120. FIG. 7 shows the elevator car 1 according to the present disclosure, in which the decorative ceiling cover panel 30 has been pivoted down, but the working platform 6 is still in the stowed position. The counterweights 120 are shown as each being arranged in a vertical stack and retained within a surrounding structure 122 (such as a tube). The surrounding structure 122 retains the counterweights 120 in position to move along a fixed vertical path, and ensures that they do not fall into the hoistway which could pose a danger. However, there could be no surrounding structure, or a different shape of structure to that shown. Additionally there could be any number of counterweights, for example a single counterweight. In some examples there is at least one counterweight, or a set of counterweights, on each of two opposing sides of the working platform 6. This advantageously provides increased stability and a more symmetrically balanced counterforce to the working platform 6.

When the working platform 6 is in the stowed position, as shown in FIG. 7, the counterweights 120 are at their lowest position, at the bottom of the surrounding structure 122, close to the floor 121 of the elevator car. The side walls of the car have been omitted for clarity. As the working platform 6 is moved out of the stowed position and away from the support frame 4, down towards the operational position, as shown in FIG. 8, the counterweights 120 begin to move vertically upwards, i.e. away from the car floor 121. The working platform 6 shown in FIG. 8 is suspendably connected to the support frame 4 by suspension arrangements 8*a*, 8*b*, shown here schematically (omitting the detail which is seen in FIGS. 1-6).

Once the working platform 6 is in the operational position, as shown in FIG. 9, the counterweights 120 are at their uppermost position within the surrounding structure 122. The suspension arrangements 8*a*, 8*b* are also shown schematically in FIG. 9.

The working platform 6 is connected to each of the counterweights 120 by a tension member 124, in this example a rope, as seen most clearly in FIG. 10. One end of the tension member 124 is fixed to the working platform 6 at a first connection point 126, and the other end of the tension member 124 is connected to one of the counterweights 120 at a second connection point 128. Between the first connection point 126 and the second connection point 128, the tension member 124 passes over a first deflection sheave 130 and over a second deflection sheave 132. Any number of such deflection sheaves can be used, as required. The first deflection sheave 130 converts vertical motion of the working platform 6 into horizontal motion of a section of the tension member 124, and the second deflection sheave 132 converts this horizontal motion of the section of tension member into vertical motion of the section of tension member 124, connected to the counterweight 120.

Thus, the weight of the counterweights 120 generates a counterforce that is transmitted by the tension member 124 and acts to apply an upwards vertical force to hoist the working platform 6 towards the stowed position. In some examples, the weight of the counterweights 120 provides a counterforce approximately equal to the force acting downwards on the working platform due to its weight. In some examples, the weight of the counterweights 120 provides a counterforce which is slightly larger than the downwards force acting on the working platform 6 due to its weight. As a result of this, absent any additional forces, the working platform 6 is automatically hoisted to the stowed position. When a maintenance person moves the working platform 6 from the stowed position to the operational position, he or she must then place an additional weight, for example a toolbox, or apply their own weight, to keep the working platform 6 in the operational position. Alternatively, or in addition, there may be a mechanism for holding the working platform 6 in the operational position. Additionally shown in FIG. 10 is the extendable suspension arrangement 8*a* shown in the previous Figures.

The arrangement of the counterweights 120 in the surrounding structures 122 is shown in more detail in FIG. 11. Each surrounding structure 122, in this example a tube, is adjacent to, and optionally fixed or attached to, a car upright 136. Car uprights 136 are existing components known in the art, and various numbers and arrangements of car upright are possible in accordance with the present disclosure. The number and placement of counterweights 120 and surrounding structures 122 can be altered depending on the number and arrangements of car uprights 136. Each surrounding structure 122 additionally includes a stopper 138 at the bottom of the surrounding structure 122, which prevents the counterweights 120 from falling out of the bottom of the surrounding structure 122, possibly into the hoistway which could create a danger (e.g. in the event of there being a fault with the tension member 124, or a counterweight 120 becoming detached).

In the example seen in FIG. 10, the tension member 124 is fixed at one end to the counterweight 120 and fixed at its other end to the working platform 6, i.e. a 1:1 roping. However, it will be appreciated that other roping ratios may be used instead, for example the tension member 124 could be arranged to undersling the working platform 6 with its other end fixed to a suitable connection point in the car (e.g. on the opposite upright 136 or on the support frame 4).

A second example is shown in FIGS. 12-15. In this example, the counterforce generator comprises a spring element 140, in particular a gas spring. This is advantageous because gas springs are more reliable than coil springs. In the particular example shown, the spring element 140 is attached to the working platform 6, specifically to the underside of the working platform 6. The spring element 140 could alternatively be attached to a top or side surface of the working platform 12, but when attached to the underside the spring element 140 is less likely to get in the way of a maintenance person using the working platform 6. Alternatively, the spring element 140 may be attached to another suitable component of the elevator car 1, such as the support frame 4 or other stationary part of the elevator car ceiling. In FIG. 12, the working platform 6 is shown in the stowed position, with the decorative ceiling cover panel 30 in the open position. It can be seen that the spring element 140 has a piston 152 which is in a fully extended position and thus there is zero counterforce.

As the working platform 6 is moved down between the stowed position and the operational position, as shown in FIG. 13, the spring element 140 is partially compressed. FIG. 14 shows the working platform 6 in the operational position. In this position, as shown, the spring element 140 is fully compressed.

As shown in FIGS. 12, 13 and 14, the piston 152 of the spring element 140 is connected to a tension member 124, which could, for example, be a rope. In the particular example shown, the tension member 124 also passes through a deflection plate 150 that is fixed to the working platform 6, before then passing through an aperture 154 in the working platform 6. The number of times that the tension member 124 passes back and forth between the deflection plate 150 and the piston 152 can be adjusted to give a gearing effect as horizontal movement of the piston 152 is translated into vertical movement of the tension member 124. Any other suitable roping arrangement, which results in the spring element 140 being compressed as the working platform 6 is moved from the stowed position to the operational position, is possible in accordance with the present disclosure.

FIG. 15 shows how the tension member 124 passes through the aperture 154 in the working platform and extends vertically to be connected at its second end to a connection point 156 in the elevator car 1 that moves relative to the working platform 6, as the working platform 6 is moved from the stowed position to the operational position. In this example, the point 156 is a pivot point of the extendable suspension arrangement 8*b* that controls movement of the working platform 6 relative to the support frame 4. The suspension arrangements 8*a*, 8*b* are as described with reference to the earlier Figures. Connecting the tension member 124 to the pivot point of the extendable suspension arrangement 8*b* advantageously allows the stroke of the spring element 140 to be reduced and consequently is particularly well suited for small elevator cars. The second end of the tension member 124 could alternatively be connected to a fixed point in the elevator car 1, such as a car floor or ceiling. In another set of examples, the second end of the tension member 124 is connected to the pivot point of the extendable suspension arrangement 8*b* and the first end of the tension member 124 is connected to a spring element 140 that is attached to the support frame 4 or other part of the car ceiling, rather than being attached to the working platform 6.

Although, in this example, the first end of the tension member 124 is connected to a spring element 140 which is attached to the working platform 6, with the second end attached to a point 156 which moves relative to the working platform 6 as the working platform 6 is moved down in the elevator car 1, alternatively, the spring element 140 could be attached to a fixed structure within the elevator car 1, and the second end of the tension member 124 could be connected to the working platform 6. For example, the spring element 140 could be attached to the support frame 4 or elsewhere above the ceiling of the elevator car 1. This would still provide compression of the spring element 140, and hence a counterforce, as the working platform 6 is moved from the stowed position to the operational position, and the tension member 124 could still be arranged to hoist the working platform 6 in the upwards vertical direction.

As a result of the arrangement described above, the spring element 140 provides a counterforce as the working platform 6 is moved downwards into the operational position, due to the compression of the spring element 140. This damping effect can make it safer for a maintenance person to handle the working platform 6. Then, once the working platform 6 is in the operational position, this counterforce is transmitted by the tension member 124, to hoist the working platform 6 back towards the stowed position. In some examples, the counterforce provided by the spring element 140 could be less than or approximately equal to the downward force acting on the working platform 6 due to its weight, so that once moved to the operational position it tends to stay there. In other examples, the counterforce provided by the spring element 140 may be larger than the downward force acting on the working platform 6 due to its weight, such that once moved to the operational position, the working platform 6 will tend to move back upwards to the stowed position unless an additional weight, such as a toolbox, or a maintenance person, is placed on the working platform 6.

In yet other examples, as shown in FIGS. 16-23, the counterforce generator is a hoisting device, which, when actuated by a maintenance person, changes the length of a suspending portion of a tension member, thereby hoisting or lowering the working platform as required, and thus helping the maintenance person to move the working platform 6 between the operational and stowed positions, in a controlled manner and without having to support its weight.

FIGS. 16 and 17 show a working platform 6 according to an example of the present disclosure. The working platform 6 is in the operational position. In FIG. 16 the top surface 213 of the working platform 6 is visible, in FIG. 17 the underside 214 of the working platform 6 is visible. In addition to the suspension arrangements 8*a*, 8*b* (which are shown schematically, omitting some of the detail shown in the earlier Figures) the working platform 6 is also connected to the support frame 4 by a first tension member 216*a* and a second tension member 216*b*, although as described above, these tension members could be connected instead to an intersection point of the suspension arrangements 8*a*, 8*b*. The first tension member 216*a* is close to a first side of the working platform 6, and the second tension member 216*b* is close to a second, opposing side of the working platform 6. In this example, the first tension member 216*a* passes through the intersection point 215*a*, or apex, of the extendable suspension arrangement 8*a*. The second tension member 16*b* passes through the intersection point 15*b*, or apex, of the extendable suspension arrangement 8*b*. The working platform 6 includes a ladder 230, which a maintenance person can fold down in order to climb up onto the working platform 6.

Each tension member 216*a*, 216*b* is connected to the support frame 4 at a first end of the respective tension member 216*a*, 216*b*. The second end of each tension member 216*a*, 216*b* is connected to a hoisting device 218 according to the present disclosure, as shown in FIG. 17. Each tension member 216*a*, 216*b* includes a suspending portion 217*a*, 217*b* between the support frame 4 and the working platform 6, which is suspending the working platform 6, or would be if it were not for the suspension arrangements 8*a*, 8*b*. In the example as shown, each suspending portion 217*a*, 217*b* is substantially vertical. The hoisting device 218 is shown in more detail in FIG. 18.

FIG. 18 shows the arrangement of the hoisting device 218 when the working platform 6 is in the operational position, as shown in FIGS. 16 and 17. In this example, the hoisting device 218 includes a worm screw 220 and a sliding member 222. The mechanism of a worm screw is such that as the worm screw 220 is turned, by means of end connection 232, the sliding member 222 slides along the worm screw 220. The direction (up or down, as viewed in FIG. 18) in which the sliding member 222 moves is determined by the direction of rotation of the worm screw 220. By the meshing of the thread of the worm screw 220 and the corresponding worm gear within the sliding member 222, the rotational motion of the worm screw 220 is converted into longitudinal motion of the sliding member 222. The thread angle (pitch angle) and thread depth of the worm screw are chosen such that the worm screw is self-locking i.e. so that if a maintenance person stops turning the worm screw 220 then the worm screw 220 will remain stationary and so will the sliding member 222. Thus the working platform 6 will remain stationary as long as the worm screw is not turned i.e. actuated (unless of course, the working platform is moved by a different means e.g. manually lifted). This allows the working platform 6 to be raised or lowered to intermediate positions, and then held there without requiring effort from the maintenance person. Often a locking mechanism is included at the support frame 4, to allow the working platform 6 to be locked in the stowed position. However, using the hoisting device 218 of the present invention, the working platform 6 can be locked in the stowed position without use of such an additional locking mechanism, simply using the self-locking of the hoisting device.

The sliding member 222 includes a hole which is configured to receive the worm screw and act as a worm-gear i.e. convert rotational motion of the worm screw into longitudinal motion of the sliding member 222 along the worm screw 220. The hole which receives the sliding member 222 is a plastic self-lubricating ring comprising grooves, which provide the worm-gear mechanism. This allows for easy movement of the sliding member 222 along the worm screw 220.

The hoisting device 218 also includes a first elongate rod 226 and second elongate rod 228. The sliding member 222 is arranged to slide along these rods 226, 228 as it moves along the worm screw 220. These rods 226, 228 are smooth so that the sliding member 222 can slide smoothly along them, as it moves, but help to provide stability to the sliding member 222 and prevent it from twisting.

The hoisting device 218 also includes a first deflection sheave 224*a* and a second deflection sheave 224*b*. As shown, when the working platform 6 is in the operational position, the sliding member 222 is close to a first end 234 of the worm screw, the end which is nearer to the first and second deflection sheaves 224*a*, 224*b*. The first end 234 is also nearer to the end connection 232. When the sliding member 222 is at this first end, very little of the tension members 216*a*, 216*b*, is passing back and forth between the respective deflection sheaves 224*a*, 224*b* and the sliding member 222, and therefore the remaining length of the tension members 216*a*, 216*b* i.e. the length of the suspending portion 217*a*, 217*b* (not shown in FIG. 18) which is suspending the working platform, is long.

The hoisting device 218 furthermore includes a third deflection sheave 236*a* and a fourth deflection shave 236*b*. These deflection sheaves 236*a*, 236*b* direct the tension members 216*a*, 216*b* towards the outer edges of the working platform 6, to intersection points 238*a*, 238*b*. At these intersection points, the respective tension members 216*a*, 216*b* pass through the working platform 6. The portion of each tension member 216*a*, 216*b* which is the other side of the intersection point 238*a*, 238*b* (not shown) is the suspending portion 217*a*, 217*b*.

FIGS. 19 and 20 show the working platform 6 according to the present disclosure, in the stowed position. In FIG. 19 the top surface 213 of the working platform 6 is visible, in FIG. 20 the underside 214 of the working platform 6 is visible.

FIG. 21 shows the arrangement of the hoisting device 218 when the working platform 6 is in the stowed position, as shown in FIGS. 19 and 20. The same components are labelled as in FIG. 18. As shown, when the working platform 6 is in the stowed position, the sliding member 222 is close to a second end 236 of the worm screw 220, the end which is further from the first and second deflection sheaves 224*a*, 224*b*. Thus, the tension members 216*a*, 216*b* pass around their respective deflection sheaves 224*a*, 224*b*, and pass back and forth between these deflection sheaves 224*a*, 224*b* and the sliding member 222. In the example as shown, the roping arrangement is 3:1, such that each tension member 216*a*, 216*b* passes back and forth between the deflecting sheave 224*a*, 224*b* and the sliding member 222 three times. This means that the length of the suspending portion of the tension member 217*a*, 217*b* (not shown in FIG. 21) will have been reduced by three times the length of the distance between the respective deflection sheave 224*a*, 224*b* and the sliding member 222. Thus, in the stowed position as shown in FIG. 21, a large length of each tension member 216*a*, 216*b* is 'gathered' between the sliding member 222 and the deflection sheaves 224*a*, 224*b*, meaning that the suspending portion 217*a*, 217*b* of the tension member 216*a*, 216*b* is very short.

FIG. 22 is a perspective view of the underside 214 of the working platform 6 as the working platform 6 is being moved between the operational position and the stowed position. The working platform 6 is being moved by actuation of the hoisting device 218. The hoisting device 218, specifically the end connection 232, is being rotationally driven using a crank 240. A crank is often provided as a standard tool within an elevator car. However, the crank 240 could instead be replaced by an electric drill, which requires minimal exertion from a maintenance person in order to actuate the hoisting device 218.

FIG. 23 is a side view of the working platform 6, as shown in FIG. 22, including the hoisting device 218 and the crank 240. The hoisting device 218 includes a bracket 242 arranged to limit the angle $\alpha$ at which the crank 240 extends. As shown, the crank 240 extends from the end connection 232 at an angle of $\alpha$, where $\alpha$ is between approximately 120° and 150°. This helps to protect the technician from harm.

Although the examples described above in relation to FIGS. 16-23 include a hoisting device in the form of a worm screw, it will be appreciated that this mechanism could be replaced by another type of linear drive or any other device that can be operated to change the length of the tension members. For example, a gas spring or reduction gear assembly might be employed instead.

As shown in FIGS. 1, 9 and 14-15, in all of the examples described above the working platform 6, 12, can be lowered from the stowed position into the interior space 2 of the elevator car to an operational position. The height of the operational position is determine by the range of movement of the extendable suspension arrangement. It is in this operational position that a maintenance person can use the working platform 6, 12 to stand on, and thereby access parts of the elevator system through the open ceiling for maintenance purposes. In particular, the height of the working platform 6, 12 in the operational position is ideally 1.0 m or 1.1 m below the support frame 4, 8. This means that a maintenance person standing fully upright on the working platform 8, 12 will protrude out of an opening in the ceiling of the elevator car 1 as provided by the support frame 4, 8. Furthermore, providing a minimum distance of 1.0 or 1.1 m between the working platform 6, 12 and the support frame, in the operational position, means that a maintenance person can take refuge in a safety space defined in the interior of the car in an emergency. The examples of an extendable suspension arrangement as disclosed herein provide a sufficient range of movement even when the car dimensions are small and a compact arrangement is needed in the stowed position.

FIG. 24 is a perspective view of an elevator system 101 including a hoistway 117. An elevator car 1, according to the present disclosure, and a main counterweight 105 move in a vertical direction along the hoistway 117. There is seen an elevator car 1, a main counterweight 105, a set of one or more ropes and/or belts 107, a guide rail 109, a machine 111, a position reference system 113, and a controller 115. The elevator car 1 and main counterweight 105 are connected to each other by the set of ropes/belts 107*s*. The main counterweight 105 is configured to balance a load of the elevator car 1 and is configured to facilitate movement of the elevator car 1 concurrently and in an opposite direction with respect to the main counterweight 105 within an elevator hoistway 117 and along the guide rail 109.

The ropes and/or belts 107 engage the machine 111, which is part of an overhead structure of the elevator system 101. The machine 111 is configured to control movement between the elevator car 1 and the main counterweight 105. The position reference system 113 may be mounted on a fixed part at the top of the elevator hoistway 117, such as on a support or guide rail, and may be configured to provide position signals related to a position of the elevator car 1 within the elevator hoistway 117.

The controller 115 is located, as shown, in a controller room 123 of the elevator hoistway 117 and is configured to control the operation of the elevator system 101, and particularly the elevator car 1. For example, the controller 115 may provide drive signals to the machine 111 to control the acceleration, deceleration, levelling, stopping, etc. of the elevator car. The controller 115 may also be configured to receive position signals from the position reference system 113 or any other desired position reference device. When moving up or down within the elevator hoistway 117 along guide rail 109, the elevator car 1 may stop at one or more sets of landing doors 125 as controlled by the controller 115. Furthermore, the controller 115 may be used to drive the elevator car 1 to any position in the hoistway 117 where a maintenance person seeks sight of or access to components in the hoistway 117. Once the elevator car is safely held at such a position, a maintenance person riding in the car may deploy the working platform as already described above. Although shown in a controller room 123, those of skill in the art will appreciate that the controller 115 can be located and/or configured in other locations or positions within the elevator system 101.

In one or more examples of the present disclosure, the elevator car 1 has relatively small dimensions, for example a car depth of 800 mm and a car width of 800 mm.

It will be appreciated by those skilled in the art that the disclosure has been illustrated by describing one or more specific aspects thereof, but is not limited to these aspects; many variations and modifications are possible, within the scope of the accompanying claims.

What is claimed is:

1. An elevator car (1) defining an interior space (2) for accommodating passengers and/or cargo, the elevator car (1) comprising:

a support frame (4) positioned above the interior space (2);

a working platform (6) moveable between a stowed position, above the interior space (2), and an operational position, within the interior space (2); and at least one extendable suspension arrangement (8*a*, 8*b*) arranged to suspend the working platform (6) from the support frame (4), the extendable suspension arrangement (8*a*, 8*b*) comprising:

a connection plate (10*a*, 10*b*, 10*c*, 10*d*);

a first arm member (12*a*, 12*b*, 12*c*, 12*d*) connected at a first end (3*a*, 3*b*, 3*c*, 3*d*) to the support frame (4) and slidably connected to a first connection point (16*a*, 16*b*, 16*c*, 16*d*) of the connection plate (10*a*, 10*b*, 10*c*, 10*d*);

a second arm member (14*a*, 14*b*, 14*c*, 14*d*) connected at another first end (5*a*, 5*b*, 5*c*, 5*d*) to the working platform (6) and slidably connected to a second connection point (18*a*, 18*b*, 18*c*, 18*d*) of the connection plate (10*a*, 10*b*, 10*c*, 10*d*);

wherein the first arm member (12*a*, 12*b*, 12*c*, 12*d*) and the second arm member (14*a*, 14*b*, 14*c*, 14*d*) are configured to slide parallel to each other, along a sliding direction (13*a*), in order to extend the extendable suspension arrangement (8*a*, 8*b*) when the working platform (6) moves between the stowed position and the operational position, and wherein the first connection point (16*a*, 16*b*, 16*c*, 16*d*) and the second connection point (18*a*, 18*b*, 18*c*, 18*d*) have an offset (17*a*) from one another across the connection plate at least in a direction perpendicular to the sliding direction (13*a*).

2. The elevator car (1) of claim 1, wherein the first connection point (16*a*, 16*b*, 16*c*, 16*d*) and the second connection point (18*a*, 18*b*, 18*c*, 18*d*) additionally have another offset (19*a*) from one another along the sliding direction (13*a*).

3. The elevator car (1) of claim 1, wherein the connection plate (10*a*, 10*b*, 10*c*, 10*d*) comprises a pivot point (28*a*, 28*b*, 28*c*, 28*d*) arranged such that the connection plate (10*a*, 10*b*, 10*c*, 10*d*) rotates about the pivot point (28*a*, 28*b*, 28*c*, 28*d*) when the working platform (6) moves between the stowed position and the operational position.

4. The elevator car (1) of claim 1, wherein the first connection point (16*a*, 16*b*, 16*c*, 16*d*) comprises a first projection and wherein the first arm member (12*a*, 12*b*, 12*c*, 12*d*) comprises a slot (20*a*, 20*b*), and the first projection is configured to slide in the slot.

5. The elevator car (1) of claim 4, wherein the slot (20*a*, 20*b*) extends along substantially the entire length of the first arm member (12*a*, 12*b*, 12*c*, 12*d*).

6. The elevator car (1) of claim 4, wherein the connection plate (10*a*, 10*b*, 10*c*, 10*d*) comprises a second projection (24*a*, 24*b*), wherein the second projection (24*a*, 24*b*) is also configured to slide in the slot (20*a*, 20*b*) of the first arm member (12*a*, 12*b*, 12*c*, 12*d*).

7. The elevator car (1) of claim 1, comprising a first extendable suspension arrangement (8*a*) and a second extendable suspension arrangement (8*b*), wherein the first extendable suspension arrangement (8*a*) suspends the working platform (6) from a first side of the support frame (4), and wherein the second extendable suspension arrangement (8*b*) suspends the working platform (6) from a second, opposing side of the support frame (4).

8. The elevator car (1) of claim 1, wherein the first extendable suspension arrangement (8*a*, 8*b*) further comprises:

a secondary connection plate (10*b*, 10*c*);

a secondary first arm member (12*b*, 12*c*) connected at a first end (3*b*, 3*c*) to the support frame (4) and slidably connected to a first connection point (16*b*, 16*c*) of the secondary connection plate (10*b*, 10*c*);

a secondary second arm member (14*b*, 14*c*) connected at a first end (5*b*, 5*c*) to the working platform and slidably connected to a second connection point (18*b*, 18*c*) of the secondary connection plate (10*b*, 10*c*);

wherein the first arm member and the second arm member are configured to slide parallel to each other, along a sliding direction, and wherein the first connection point (16*b*, 16*c*) and the second connection point (18*b*, 18*c*) are offset from one another at least in a direction perpendicular to the sliding;

wherein the first connection plate (10*a*, 10*d*) and the secondary connection plate (10*b*, 10*c*) are attached together at their respective pivot points (28*a*, 28*b*, 28*c*, 28*d*), so as to be movable relative to each other.

9. The elevator car (1) of claim 8, wherein the counterforce generator comprises at least one deflector (130, 132, 154, 224*a*, 224*b*, 236*a*, 236*b*) such as a deflection sheave, and the tension member is arranged to pass over the at least one deflector, and wherein the tension member is arranged in a roping ratio of at least 2:1 with the hoisting device.

10. The elevator car (1) of claim 1, further comprising a counterforce generator (120, 140, 218) configured to provide a counterforce; and a tension member (124, 216*a*, 216*b*), connected to the working platform (6) and to the counterforce generator (120, 140, 218), so as to transmit the counterforce and thereby hoist the working platform (6) from the operational position to the stowed position.

11. The elevator car (1) of claim 10, wherein the counterforce generator (120, 140, 218) is a hoisting device; and wherein the tension member (124, 216*a*, 216*b*) is arranged such that a suspending portion (217*a*, 217*b*) of the tension member suspends the working platform (6), wherein the hoisting device is configured, when actuated, to alter the length of the suspending portion (217*a*, 217*b*), so as to hoist the working platform between the stowed position and the operational position.

12. The elevator car (1) of claim 10, wherein the counterforce generator comprises at least one spring element (140) and the spring element is arranged to be compressed as the working platform (6) is moved from the stowed position to the operational position, and thereby provide the counterforce acting to move the working platform (6) from the operational position to the stowed position.

13. The elevator car (1) of claim 10, wherein the counterforce generator comprises at least one counterweight (120) and the tension member (124) is fixed at one end to the at least one counterweight (120) and connected to the working platform (6) such that, as the at least one counterweight (120) moves downwards vertically relative to the elevator car (1), the working platform (6) is hoisted in from the operational position to the stowed position.

14. The elevator car (1) of claim 10, wherein the counterforce generator (218) is a worm screw.

15. An elevator system (101) comprising an elevator car (1) according to claim 1, further comprising a main counterweight (105) and one or more ropes or belts (107) connected between the elevator car (1) and the main counterweight.

* * * * *